US005723250A

United States Patent [19]

Matsuoka et al.

[11] Patent Number: 5,723,250

[45] Date of Patent: Mar. 3, 1998

[54] PROCESS FOR IMAGE FORMATION USING LIQUID DEVELOPER

[75] Inventors: Hirotaka Matsuoka; Takako Kobayashi; Ken Hashimoto, all of Minami-ashigara, Japan

[73] Assignee: Fuji Xerox Co., Ltd., Tokyo, Japan

[21] Appl. No.: 778,360

[22] Filed: Jan. 2, 1997

Related U.S. Application Data

[62] Division of Ser. No. 421,871, Apr. 14, 1995, Pat. No. 5,622,804.

[30] Foreign Application Priority Data

May 30, 1909 [JP] Japan ..... 6-137823
May 30, 1994 [JP] Japan ..... 6-137822

[51] Int. Cl.[6] ..... G03G 13/10

[52] U.S. Cl. ..... 430/117; 430/119

[58] Field of Search ..... 430/117, 115, 430/116, 119

[56] References Cited

U.S. PATENT DOCUMENTS

| | | |
|---|---|---|
| 3,264,272 | 8/1966 | Rees . |
| 3,417,019 | 12/1968 | Beyer . |
| 4,794,651 | 12/1988 | Landa et al. . |
| 5,229,235 | 7/1993 | Watanabe et al. . |
| 5,352,557 | 10/1994 | Matsuoka et al. . |
| 5,404,209 | 4/1995 | Matsuoka et al. . |
| 5,409,796 | 4/1995 | Fuller et al. . |
| 5,411,834 | 5/1995 | Fuller et al. . |
| 5,529,874 | 6/1996 | Kobayashi et al. . |

FOREIGN PATENT DOCUMENTS

| | | |
|---|---|---|
| 53-057039 | 5/1978 | Japan . |
| 58-2851 | 1/1983 | Japan . |
| 58-152258 | 9/1983 | Japan . |
| 59-87463 | 5/1984 | Japan . |
| 2-6965 | 1/1990 | Japan . |
| 5-72820 | 3/1993 | Japan . |

OTHER PUBLICATIONS

Diamond, Arthur S. Handbook of Imaging Materials. New York: Marcel-Dekker, Inc. pp. 227–231, 1991.

Savin Competitive Copier Guide, Savin 880/870, 1 page, May 1984.

K. A. Metcalfe, "Liquid Developers For Xerography," *Journal of Scientific Instruments*, vol. 32, Feb. 1955, p. 74.

K. A. Metcalfe, "Fine Grain Development in Xerography," *Journal of Scientific Instruments*, vol. 33, May 1956, pp. 194–195.

English Abstract of JP 58–152258 (1983).

Arthus S. Diamond, *Handbook of Imaging Materials*, New York:Marcel-Dekker, Inc. pp. 231–236, 239–244 (1991).

*Primary Examiner*—Christopher D. Rodee
*Attorney, Agent, or Firm*—Oliff & Berrdige, P.L.C.

[57] ABSTRACT

A liquid developer for electrophotography is disclosed, which comprises a carrier, a charge director contained in the carrier, and toner particles dispersed in the carrier and having a volume-average particle diameter of from 0.5 μm to 5 μm, wherein the toner particles comprises a thermoplastic resin substantially insoluble in the carrier at a temperature used for development, a colorant dispersed in the resin, and a charge control agent. A process for producing the liquid developer, and a process for forming an image are also disclosed. Thereby, a liquid developer for electrophotography having good toner electrification characteristics and satisfactory charge stability is obtained.

7 Claims, 2 Drawing Sheets

PROCESS FOR IMAGE FORMATION USING LIQUID DEVELOPER

This is a Division of application Ser. No. 08/421,871 filed Apr. 14, 1995, now U.S. Pat. No. 5,622,804.

FIELD OF THE INVENTION

The present invention relates to a liquid developer for electrophotography which contains toner particles capable of being negatively or positively charged. This invention also relates to a process for producing the developer and a process for image formation using the developer.

BACKGROUND OF THE INVENTION

A generally employed process for wet development in electrophotography comprises charging a photoreceptor, imagewise exposing the charged photoreceptor to form an electrostatic latent image, developing the latent image with a liquid developer which is a dispersion of toner particles consisting mainly of a resin and a colorant usually in an aliphatic hydrocarbon, and then transferring and fixing the obtained toner image to receiving paper to form an image. In this process, when a photosensitive paper or film coated with a photoconductive material, e.g., zinc oxide, is used as a photoreceptor, the transfer step may be omitted to directly fix the developed toner image to the photoreceptor. Wet development is frequently utilized also as a developing means in other recording processes including electrostatic recording, in which an electrostatic latent image is formed on a dielectric by means of electrical input without using a photoreceptor.

In wet development, a dispersion of fine toner particles of from a submicron size to about several micrometers in a high-electrical-resistivity carrier liquid, e.g., an aliphatic hydrocarbon as mentioned above, is used to develop a latent image mainly by means of electrophoresis. This technique therefore has an advantage that images having high resolution are more easily obtained than dry development with toner particles of several micrometers or larger.

However, since the liquid developer having a submicron toner particle diameter is reduced in charge amount per toner particle, the rate of electrophoretic development with the developer is low. As a result, the conventional liquid developer has problems that (1) an increased image density is not obtained and (2) the liquid developer is unsuitable for high-speed copying. In addition, most of the toners investigated so far have drawbacks that they show poor adherence to substrates because fixing thereof is based on the drying, solidification, and adhesion of the resin dissolved in the carrier liquid, and that the images formed therefrom have insufficient mechanical strength because the cohesive force of the image parts themselves is low.

To mitigate these drawbacks, a liquid developer comprising an aliphatic hydrocarbon and dispersed therein toner particles consisting mainly of a thermoplastic resin and a colorant and having an average particle diameter of several micrometers has been proposed as described in JP-A-58-2851, JP-A-58-152258, JP-A-59-87463, and U.S. Pat. No. 4,794,651. (The term "JP-A" as used herein means an "unexamined published Japanese patent application.")

However, the proposed liquid developer, which is a mere dispersion in an aliphatic hydrocarbon of toner particles containing a thermoplastic resin, has a drawback that when a latent image formed on an electrophotographic photoreceptor is developed with the liquid developer by a known method for liquid development, an image of low quality with low image density and low resolution is obtained in most cases or no image is obtained in some cases, although adherence to substrates and the mechanical strength of images are improved. Thus, the prior art liquid developer has failed to be put to practical use.

The poor suitability for development and poor transferability described above are attributable to the insufficient control of the charge of toner particles. For improving image quality, use of a charge director, e.g., a dye or a metal soap, conventionally employed in liquid developers is indispensable.

The ordinary method for controlling the electrification of a toner by means of a charge director has been to add the charge director to a carrier liquid during developer preparation, as stated in two early reports by K. A. Metcalfe [*J. Sci. Instrum.*, 32, 74 (1955) and Ibid., 33, 194 (1956)]. However, since such charge directors, e.g., a metal soap, generally lower the electrical resistance of carrier liquids considerably. It is therefore desirable from experience that for obtaining satisfactory image properties, a charge director be added to a carrier liquid in an amount as small as possible. On the other hand, in order to satisfactorily charge a toner, higher charge director concentrations in the carrier liquid are desirable; this is contrary to the above. The above-described method for toner charge control only by the post-addition of a charge director is disadvantageous in that actual copying operation using the thus-obtained liquid developer results in a change in the electrical resistance of the liquid developer from the initial value thereof due to the pressure of the unconsumed charge director remaining in the carrier liquid, so that stable formation of images is impossible. Moreover, in order for a metal soap or another compound to produce the effect of a charge director, it should form micelles in the carrier liquid used to thereby dissolve therein in some degree. However, most metal soaps and other charge director compounds are insoluble or sparingly soluble in the hydrocarbons, e.g., normal paraffins and isoparaffins, actually used advantageously as the carrier liquids of liquid developers, so that the desired charge control effect has not been obtained sufficiently.

In JP-A-58-152258 is proposed a process for producing a liquid developer, in which process a resin insoluble in solvents at room temperature is heated and melted along with a colorant and a charge control agent, e.g., a metal soap, in an appropriate solvent, this melt is cooled to room temperature to obtain a particulate toner, and the solvent is then replaced with the carrier liquid to be actually used. The developer obtained by this prior art process has an advantage that the carrier liquid can have reduced electrical resistance and relatively satisfactory images can be obtained initially. However, it has a drawback that it becomes impossible to obtain satisfactory images as copying is continued on a copier for practical use. Such image defects become severer especially when the toner concentration of the liquid developer varies considerably or when the temperature or humidity of the surrounding air changes. The reason for this may be as follows. In a developer which does not contain a charge director in the carrier liquid, no sites having the function of charge stabilization are present or, at the most, the water contained in the developer in a slight amount, hydrophilic impurities dissolved in the water, and other substances function as quasi charge stabilization sites. As a result, charge exchange between (1) toner particles and a charge director and between (2) toner particles and toner particles does not sufficiently occur and is influenced by variations in toner concentration, temperature, and humidity. Therefore, addition of a charge director, which is a substance used for accelerating charge exchange, to a liquid developer is indispensable.

Furthermore, most of the carrier liquids proposed so far for use in liquid developers are organic solvents having a high vapor pressure. Each carrier liquid hence has the following problems; (i) the carrier liquid vapor discharged at the time of fixing, etc. tends to cause environmental pollution, (ii) the carrier liquid vapor tends to catch fire, and (iii) after fixation to a substrate, e.g., paper, the carrier liquid remaining in the substrate gradually vaporizes to emit the odor of the solvent from the copy. Thus, the prior art carrier liquids are unable to sufficiently cope with present-day environmental regulations. To overcome these problems, a technique for preventing carrier vapor generation has, for example, been proposed, in which technique a high-molecular hydrocarbon substantially solid at ordinary temperature is used as a carrier and the development of an electrostatic latent image is conducted while the carrier is kept in a molten state using an appropriate heating means. In JP-A-2-6965 and JP-A-5-72820, for example, there is a description to the effect that developers containing a carrier which is solid at ordinary temperature are superior in maintenance and handleability to developers containing a carrier which is liquid at ordinary temperature. However, the developers described in these references have poor reliability because they have problems that the colloid stability thereof is impaired with heating or repeated thermal history of heating→cooling→heating in a copier for practical use and, as a result, aggregation or coagulation of toner particles and carrier viscosity increase occur undesirably during storage.

SUMMARY OF THE INVENTION

The first object of the present invention is to provide a liquid developer for electrophotography which is capable of being negatively or positively charged, which has good toner electrification characteristics and shows satisfactory charge stability in a copier for practical use, and with which images of better quality can be obtained over a prolonged time period, without posing the above-described problems or disadvantages; and to provide a process for producing this liquid developer for electrophotography and a process for image formation using the liquid developer.

The second object of the present invention is to provide a liquid developer for electrophotography which is effective in reducing the amount of carriers discharged from copiers and printers of the wet development type and which is odorless and has little danger of fire.

The liquid developer for electrophotography of the present invention comprises a carrier, a charge director contained in the carrier, and toner particles dispersed in the carrier and having a volume-average particle diameter of from 0.5 μm to 5 μm, said toner particles comprising a thermoplastic resin substantially insoluble in the carrier at a temperature used for development, a colorant dispersed in the resin, and a charge control agent.

The process of the present invention for producing the liquid developer for electrophotography described above comprises mixing an organic solvent with a thermoplastic resin, a colorant, and a charge control agent with heating to obtain a melt, cooling the melt to precipitate from the organic solvent a particulate toner comprising the thermoplastic resin containing both the colorant and the charge control agent therein, regulating the toner particles so as to have a volume-average particle diameter of from 0.5 μm to 5 μm, and then mixing the toner particles with a carrier liquid in which the toner particles are substantially insoluble at the temperature of the liquid developer during development and with a charge director.

The process of the present invention for forming an image comprises the step of forming a latent image on a latent-image-holding substrate and the step of developing the latent image with the liquid developer for electrophotography described above.

DETAILED DESCRIPTION OF THE INVENTION

Figure 1:
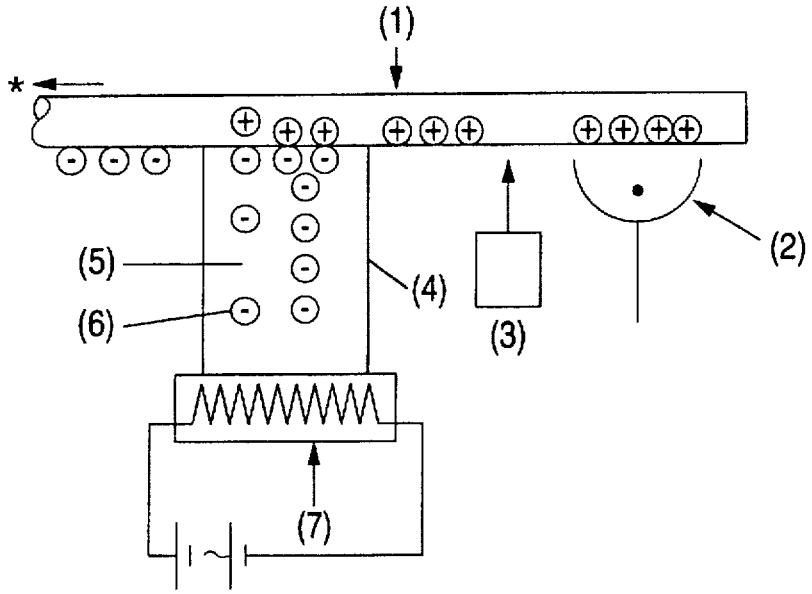
FIGS. 1(*a*) and 1(*b*) is a view illustrating the image formation process of the present invention.
Figure 1:
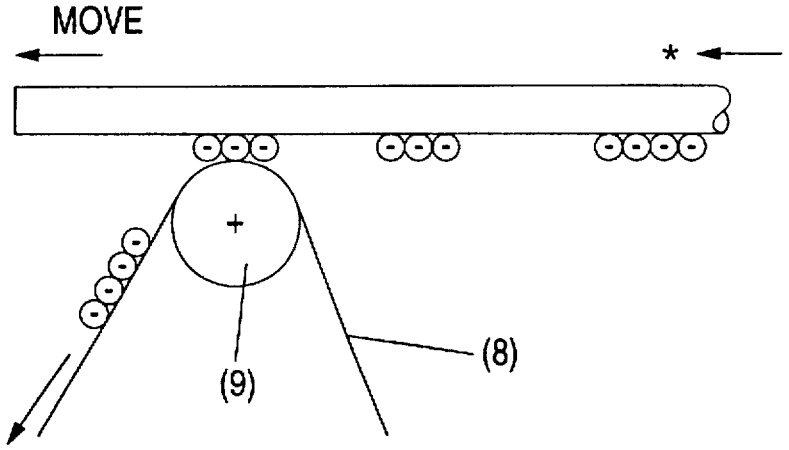

The liquid developer for electrophotography of the present invention is composed substantially of three components, i.e., a toner, a carrier, and a charge director.

The term "liquid developer" in the present invention means a developer which is liquid when in use for development and may be solid at ordinary temperature.

The term "composed substantially of" means that any ingredient which does not adversely influence the advantages of the developer should not be excluded from the composition of the developer. For example, the liquid developer may contain a metal oxide in fine particle form, a metal soap, and other additive ingredients including auxiliaries.

The term "negative- or positive-charge control agent" used in the present invention means a substance which is present on and within toner particles and functions as sites where negative or positive charges generate. The term "charge director" means a substance which is present on the carrier side and serves to stabilize charge exchange between toner particles and the carrier. It is presumed, for example, that in the case of using toner particles containing a negative-charge control agent having the structure of a salt, the charge director contained in the carrier functions to stabilize the counter ions present due to the charge control agent and, as a result, charge exchange between the toner and the carrier is accelerated and stabilized.

First, the toner particles capable of being negatively or positively charged are explained. The negatively or positively electrifiable toner particles are formed from a thermoplastic resin, a colorant, and a negative- or positive-charge control agent.

Any thermoplastic resin may be used for forming the toner particles as long as the thermoplastic resin used is substantially insoluble in the carrier at the temperature of the developer during development. Examples thereof include polyolefins such as polyethylene and polypropylene. Especially preferred are ethylene copolymers having a polar group, e.g., copolymers of ethylene with α,β-ethylenically-unsaturated acids, such as acrylic acid and methacrylic acid, or with alkyl esters of these acids and ionomers obtained from such ethylene copolymers by converting the acid moieties into a metal salt, amine salt, or ammonium salt. A process for synthesizing this type of copolymers is described, e.g., in U.S. Pat. No. 3,264,272 to Ree.

Examples of the thermoplastic resin further include homopolymers of styrene, o-, m-, or p-methylstyrene, α-methylstyrene, p-ethylstyrene, 2,4-dimethylstyrene, and the like, styrene-acrylic copolymers, and copolymers of styrene with other monomers.

Examples of the acrylic monomers used for producing the styrene-acrylic copolymers include methyl acrylate, ethyl acrylate, propyl acrylate, n-butyl acrylate, isobutyl acrylate, n-hexyl acrylate, n-octyl acrylate, 2-ethylhexyl acrylate, decyl acrylate, lauryl acrylate, stearyl acrylate, 2-chloroethyl acrylate, phenyl acrylate, and the corresponding methacrylic esters. Examples thereof further include α-methylenemonocarboxylic acid esters such as dimethylaminoethyl methacrylate and diethylaminoethyl methacrylate, ammonium methacrylate, and betaines thereof.

Also usable are homopolymers of the acrylic acid derivatives enumerated above, homopolymers of perfluorooctyl (meth)acrylate, vinyltoluenesulfonic acid, and the sodium salt, vinylpyridine compound, and pyridinium salt thereof, copolymers of these monomers with other monomers, copolymers of a diene, e.g., butadiene or isoprene, with a vinyl monomer, and polyamide resins based on a dimer acid. Moreover, polyesters, polyurethanes, and the like may be used alone or as a mixture with the resins enumerated above.

The colorant dispersed in the above-described thermoplastic resin in the present invention may be an organic or inorganic pigment, a dye, or an oil-soluble dye. Examples thereof include C.I. Pigment Red 48:1, C.I. Pigment Red 57:1, C.I. Pigment Red 122, C.I. Pigment Red 17, C.I. Pigment Yellow 97, C.I. Pigment Yellow 12, C.I. Pigment Blue 15:1, C.I. Pigment Blue 15:3, lamp black (C.I. No. 77266), Rose Bengal (C.I. No. 45432), carbon black, Nigrosine dye (C.I. No. 50415B), metal complex dyes, metal complex dye derivatives, and mixtures thereof. Examples of the colorant further include various metal oxides such as silica, aluminum oxide, magnetite and various ferrites, cupric oxide, nickel oxide, zinc oxide, zirconium oxide, titanium oxide, and magnesium oxide, and appropriate mixtures thereof.

These colorants should be incorporated into toner particles in such an amount that the toner is capable of forming a visible image having sufficient density. Although colorant amount varies depending on toner particle diameter and deposited toner amount, the adequate range thereof is generally about from 1 to 200 parts by weight per 100 parts by weight of the thermoplastic resin.

Negative- or positive-charge control agents for use in conventional liquid developers can be used in the present invention.

Preferred examples of negative-charge control agents that can be used in the present invention include those for use in powdery toners for xerography, such as metal salts of benzoic acid, metal complexes of salicylic acid, metal complexes of alkylsalicylic acids, metal complexes of catechol, metallized bisazo dyes, and tetraphenylborate derivatives, and appropriate combinations of these compounds. Of these, metal complexes of salicylic acid, metal complexes of catechol, metallized bisazo dyes, and tetraphenylborate derivatives are preferred, because they are thermally stable to conditions under which the liquid developer is heated and to various thermal histories and hence show stable electrification characteristics.

Especially preferred negative-charge control agents for use in the present invention include the following.

Preferred metal complexes of either salicylic acid or an alkylsalicylic acid are those represented by the following formula (1):

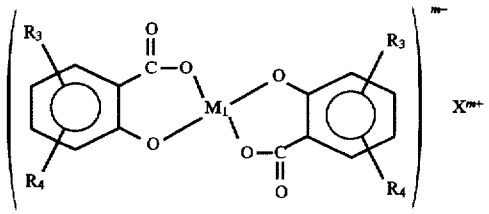

(1)

(wherein, $M_1$ represents a di- or trivalent metal, e.g., Zn, Ni, Co, Mn, Mg, Ca, Ba, Sn, Cu, Cr, Cd, Al, Fe, or B; $R_3$ and $R_4$ each represents a hydrogen atom or a $C_1$ to $C_9$ alkyl group, or $R_3$ and $R_4$ are bonded to each other to form a benzene or cyclohexane ring which may be substituted with a $C_1$ to $C_9$ alkyl group; X represents a counter ion such as H, Li, K, Na, $NH_4$, or an aliphatic ammonium cation; and m represents an integer).

Preferred metal complexes of catechol are those represented by the following formula (2):

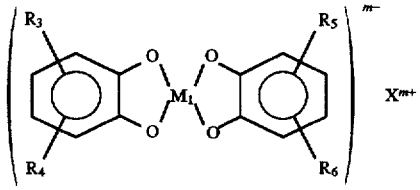

(2)

(wherein $M_1$ represents a di- or trivalent metal, e.g., Zn, Ni, Co, Mn, Mg, Ca, Ba, Sn, Cu, Cr, Cd, Al, Fe, or B; $R_3$, $R_4$, $R_5$, and $R_6$ each represents a hydrogen atom or a $C_1$ to $C_9$ alkyl group, or $R_3$, $R_4$, $R_5$, and $R_6$ are bonded to one another to form a benzene or cyclohexane ring which may be substituted with a $C_1$ to $C_9$ alkyl group; X represents a counter ion such as H, Li, K, Na, $NH_4$, or an aliphatic ammonium cation; and m represents an integer).

Preferred metallized bisazo dyes are those represented by the following formula (3):

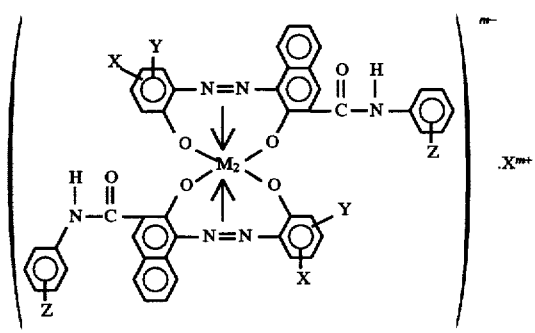

(3)

(wherein $M_2$ represents Cr or Fe; X, Y, and Z each represents a hydrogen atom, a halogen atom, a carboxyl group, a hydroxyl group, a nitro group, a sulfonic acid group, or a sulfonamido group; A represents a counter ion such as H, Li, K, Na, $NH_4$, or an aliphatic ammonium cation; and m represents an integer).

Preferred tetraphenylborate derivatives are those represented by the following formula (4):

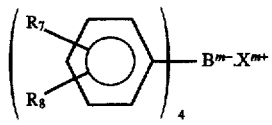

(4)

(wherein $R_7$ and $R_8$ each represents a hydrogen atom, a fluorine atom, or a $C_1$ to $C_9$ alkyl group, or $R_7$ and $R_8$ are bonded to each other to form a benzene or cyclohexane ring which may be substituted with a $C_1$ to $C_9$ alkyl group; X represents a counter ion such as H, Li, K, Na, Ca, $NH_4$, or an aliphatic cation; and m represents an integer).

The amount of these negative-charge control agents is generally from 0.1 to 10% by weight, preferably from 0.5 to 8% by weight, based on the amount of the solid components of the toner. If the amount of the negative-charge control agent is smaller than 0.1% by weight, the desired charge control effect cannot be produced sufficiently. If the amount thereof exceeds 10% by weight, the electrical conductivity of the liquid developer is increased excessively, making it difficult to use the liquid developer.

The negative-charge control agent described above may be used in combination with a metal soap or an inorganic or organic metal salt. Examples of such metal soaps include aluminum tristearate, aluminum distearate, the stearic acid salts of barium, calcium, lead, and zinc, the linolenic acid salts of cobalt, manganese, lead, and zinc, the octanoic acid salts of aluminum, calcium, and cobalt, the oleic acid salts of calcium and cobalt, zinc palmitate, the naphthenic acid salts of calcium, cobalt, manganese, lead, and zinc, and resin acid salts of calcium, cobalt, manganese, lead, and zinc. Examples of the inorganic and organic metal salts include salts made up of a cationic component selected from the group consisting of the Groups Ia, IIa, and IIIa metals of the periodic table and an anionic component selected from the group consisting of a halogen, carbonate, acetate, sulfate, borate, nitrate, and phosphate.

The positive-charge control agent for use in the present invention, which is incorporated in toner particles, may be any of the positive-charge control agents used for conventional liquid developers, or may be a compound selected from the positive-charge control agents for use in powdery toners for xerography, such as metal soaps, inorganic and organic metal salts, quaternary ammonium salts, and alkylpyridinium salts, and appropriate combinations thereof. Of these compounds, quaternary ammonium salts and alkylpyridinium salts are especially preferred, because they are thermally stable to conditions under which the liquid developer is heated and to various thermal histories and hence show stable positive electrification characteristics. Preferred quaternary ammonium salts are those represented by the following formula (5), while preferred alkylpyridinium salts are those represented by the following formula (6):

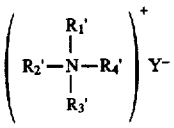

(5)

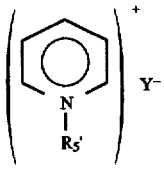

(6)

wherein $R_1'$, $R_2'$, $R_3'$, $R_4'$ and $R_5'$ each represents a $C_1$ to $C_{30}$ aliphatic group, an aromatic group, or an aliphatic group having an amide group; and Y represents a halogen atom, $CH_3SO_4^-$, $BF_4^-$ or a group represented by

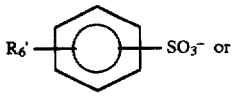

-continued

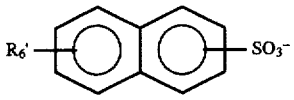

(wherein $R_6'$ represents a hydrogen atom, a $C_1$ to $C_8$ aliphatic group, or a hydroxyl group).

In formula (5) given above, $R_1'$, $R_2'$, $R_3'$, and $R_4'$ may be the same or different, and each represents an aliphatic group having 1 to 30 carbon atoms, an aromatic group, or an aliphatic group containing an amido group and represented by the formula $R_9'$—C(=O)—NH—$R_{10}'$-(wherein $R_9'$ represents an alkyl group and $R_{10}'$ represents an alkylene group). Examples of the anion include alkylsulfates and sulfonates, e.g., methylsulfate, methylsulfonates, and p-toluenesulfonate, and further include anions such as halogens and $BF_4^-$.

Specific examples of the quaternary ammonium salts and the alkylpyridinium salts represented by the above-described formulae (5) and (6), respectively, include the following.

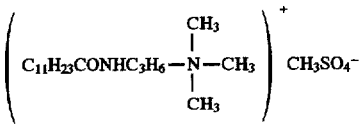

5-(1)

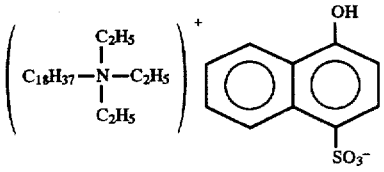

5-(2)

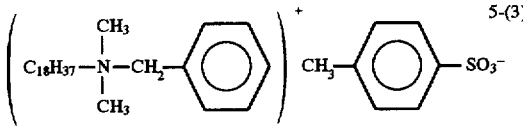

5-(3)

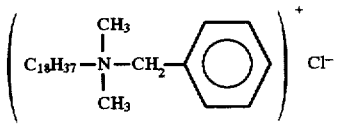

5-(4)

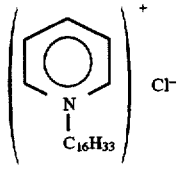

6-(1)

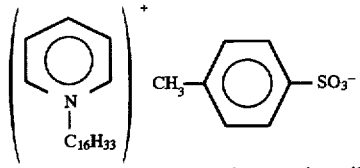

6-(2)

The positive-charge control agent described above may be used in combination with an inorganic or organic metal salt. Examples of such inorganic and organic metal salts include salts made up of a cationic component selected from the group consisting of the Groups Ia, IIa, and IIIa metals of the periodic table and an anionic component selected from the group consisting of a halogen, carbonate, acetate, sulfate, borate, nitrate, and phosphate.

The amount of these positive-charge control agents is generally from 0.1 to 10% by weight, preferably from 0.5 to 8% by weight, based on the amount of the solid components of the toner. If the amount of the positive-charge control agent is smaller than 0.1% by weight, the desired charge control effect cannot be produced sufficiently. If the amount thereof exceeds 10% by weight, the electrical conductivity of the liquid developer is increased excessively, making it difficult to use the developer.

The carrier for use in the present invention has a high electrical resistivity, preferably in the range of from $10^8$ to $10^{12}$ Ωcm. Especially preferred is a carrier having a vapor pressure at 25° C. of 130 Pa or lower or having such a low vapor pressure that its boiling point is 170° C. or higher.

Preferred examples of the carrier include the ether compounds represented by the following formula (7):

$$R_1O(C_nH_{2n}O)_xR_2 \quad (7)$$

(wherein $R_1$ and $R_2$ may be the same or different and each represents an alkyl group, a cycloalkyl group, an aryl group, or an aralkyl group, provided that the total number of carbon atoms contained in $R_1$ and $R_2$ is from 6 to 20; n is an integer of 2 or 3; and x is an integer of 0 to 3).

Specific examples of the ether compounds represented by formula (7) include the following.

Examples of ethylene glycol ethers include ethylene glycol dipropyl ether, ethylene glycol dibutyl ether, ethylene glycol dipentyl ether, ethylene glycol dihexyl ether, ethylene glycol diheptyl ether, ethylene glycol dioctyl ether, ethylene glycol dinonyl ether, ethylene glycol didecyl ether, ethylene glycol diphenyl ether, ethylene glycol ditolyl ether, ethylene glycol dixylyl ether, ethylene glycol dinaphthyl ether, ethylene glycol dibenzyl ether, ethylene glycol butyl hexyl ether, and ethylene glycol amyl 2-ethylhexyl ether.

Examples of diethylene glycol ethers include diethylene glycol dipropyl ether, diethylene glycol dibutyl ether, diethylene glycol dipentyl ether, diethylene glycol dihexyl ether, diethylene glycol diheptyl ether, diethylene glycol dioctyl ether, diethylene glycol dinonyl ether, diethylene glycol didecyl ether, diethylene glycol diphenyl ether, diethylene glycol ditolyl ether, diethylene glycol dixylyl ether, diethylene glycol dinaphthyl ether, diethylene glycol dibenzyl ether, diethylene glycol butyl hexyl ether, and diethylene glycol amyl 2-ethylhexyl ether.

Examples of propylene glycol ethers include propylene glycol dipropyl ether, propylene glycol dibutyl ether, propylene glycol dipentyl ether, propylene glycol dihexyl ether, propylene glycol diheptyl ether, propylene glycol dioctyl ether, propylene glycol dinonyl ether, propylene glycol didecyl ether, propylene glycol diphenyl ether, propylene glycol ditolyl ether, propylene glycol dixylyl ether, propylene glycol dinaphthyl ether, propylene glycol dibenzyl ether, propylene glycol butyl hexyl ether, and propylene glycol amyl 2-ethylhexyl ether.

Examples of dipropylene glycol ethers include dipropylene glycol dipropyl ether, dipropylene glycol dibutyl ether, dipropylene glycol dipentyl ether, dipropylene glycol dihexyl ether, dipropylene glycol diheptyl ether, dipropylene glycol dioctyl ether, dipropylene glycol dinonyl ether, dipropylene glycol didecyl ether, dipropylene glycol diphenyl ether, dipropylene glycol ditolyl ether, dipropylene glycol dixylyl ether, dipropylene glycol dinaphthyl ether, dipropylene glycol dibenzyl ether, dipropylene glycol butyl hexyl ether, and dipropylene glycol amyl 2-ethylhexyl ether.

Examples of dialkyl ethers include di-n-butyl ether, di-n-pentyl ether, di-n-hexyl ether, di-n-heptyl ether, di-n-octyl ether, di-n-nonyl ether, and di-n-decyl ether. Also usable are asymmetric ethers such as n-propyl n-pentyl ether, n-propyl n-hexyl ether, n-propyl n-heptyl ether, n-propyl n-octyl ether, n-butyl n-pentyl ether, n-butyl n-hexyl ether, n-butyl n-heptyl ether, n-butyl n-octyl ether, n-butyl n-nonyl ether, n-butyl decyl ether, n-butyl undecyl ether, n-butyl dodecyl ether, n-pentyl n-hexyl ether, n-pentyl n-heptyl ether, n-pentyl n-octyl ether, n-pentyl n-nonyl ether, n-pentyl n-decyl ether, n-pentyl n-undecyl ether, n-pentyl n-dodecyl ether, n-hexyl n-heptyl ether, n-hexyl n-octyl ether, n-hexyl n-nonyl ether, n-hexyl n-decyl ether, n-hexyl n-undecyl ether, n-hexyl n-dodecyl ether, n-heptyl n-octyl ether, n-heptyl n-nonyl ether, n-heptyl n-decyl ether, n-heptyl n-undecyl ether, n-heptyl n-dodecyl ether, n-octyl n-nonyl ether, n-octyl n-decyl ether, n-octyl n-undecyl ether, n-octyl n-dodecyl ether, n-nonyl n-decyl ether, and n-nonyl n-undecyl ether. Further, constitutional isomers of these ethers, e.g., i-, s-, and t-isomers, are also usable.

Examples of alicyclic alkyl ethers include dicyclopentyl ether, dicyclohexyl ether, dimethylcyclohexyl ether, n-butyl cyclopentyl ether, n-hexyl cyclopentyl ether, n-octyl cyclopentyl ether, n-decyl cyclopentyl ether, n-butyl cyclohexyl ether, n-hexyl cyclohexyl ether, n-octyl cyclohexyl ether, n-decyl cyclohexyl ether, cyclopentyl cyclohexyl ether, cyclohexylmethyl cyclohexyl ether, and cyclopentylmethyl cyclohexyl ether. Further, constitutional isomers of these ethers, e.g., i-, s-, and t-isomers, are also usable.

Examples of aryl ethers, aralkyl ethers, alkyl aryl ethers, and alkyl aralkyl ethers include diphenyl ether, ditolyl ether, dibenzyl ether, diphenethyl ether, diphenylpropyl ether, n-butyl phenyl ether, n-hexyl phenyl ether, n-octyl phenyl ether, n-butyl tolyl ether, n-hexyl tolyl ether, n-butyl benzyl ether, n-butyl benzyl ether, ethyl naphthyl ether, n-pentyl naphthyl ether, and n-butyl naphthyl ether. Further, constitutional isomers of these ethers, e.g., i-, s-, and t-isomers, are also usable.

The above-enumerated ethers for use as the carrier in the present invention may be used alone or as a mixture of two or more thereof, or may be used as a mixture with a conventionally known carrier of another kind. Examples of such known carriers usable in admixture with the ethers include the aforementioned branched aliphatic hydrocarbons, e.g., Isopar H, G, L, M, and V manufactured by Exxon Chemical Co., and linear aliphatic hydrocarbons, e.g., Norpar 14, 15, and 16 manufactured by Exxon Chemical Co. Examples thereof further include relatively high-molecular waxlike hydrocarbons such as n-undecane, n-dodecane, n-tridecane, n-tetradecane, n-pentadecane, n-hexadecane, n-heptadecane, n-octadecane, and n-nonadecane, halogenated hydrocarbons such as fluorocarbons derived from these hydrocarbons, silicone oils, and modified silicone compounds.

The carrier used in the present invention may be a compound which is substantially solid at ordinary temperature and melts upon heating.

The melting point of such carrier material which is substantially solid at ordinary temperature and melts upon heating, i.e., the temperature at which the material becomes substantially liquid, is 20° C. or higher, desirably 30° C. or higher, when the ordinary surrounding atmosphere and handleability are taken in account. Although the upper limit of the melting point, i.e., the temperature at which the carrier becomes substantially liquid, is not particularly limited, it is about 80° C., desirably 50° C. or lower, preferably 40° C. or lower, from the standpoint of practical use. It should however be noted that if the melting point of the carrier, i.e., the temperature (T1) at which the carrier becomes substantially liquid, is not lower than the temperature at which the thermoplastic resin constituting the dispersed toner particles softens or solyates with the carrier serving as the dispersion medium or not lower than the temperature (T2) at which the thermoplastic resin melts, this liquid developer is undesirable because the toner particles swell or gel in the carrier liquid at the heating temperature (T) for the liquid developer to become unable to function as "particles" in the developer. The above-described relationship is expressed by the following equation; the heating temperature (T) for the liquid developer (temperature of the developer during development) should satisfy the relationship.

$$\text{room temperature} < T1 < T < T2$$

The carrier which is substantially solid at ordinary temperature and melts upon heating should consist of one or more materials selected so as to meet the above relationship.

Examples of carrier materials which meet the above relationship include paraffins such as branched or linear aliphatic hydrocarbons, waxes, low-molecular crystalline polymeric resins, and mixtures thereof.

Examples of the paraffins include various normal or isoparaffins having about 14 to 40 carbon atoms, ranging from tetradecane ($C_{14}H_{38}$; melting point, 5.9° C.) to hexacontane ($C_{40}H_{82}$; melting point, 81.5° C.).

Examples of the waxes include vegetable waxes such as carnauba wax, cotton wax, and Japan tallow, animal waxes such as beeds wax and lanolin, mineral waxes such as ozokerite and ceresine, and petroleum waxes such as paraffins, microcrystalline wax, and petroiatum.

Also usable besides these natural waxes are synthetic hydrocarbon waxes, e.g., Fischer-Tropsch wax and polyethylene wax, and synthetic waxes such as fatty acid amides, e.g., 12-hydroxystearamide, stearamide, anhydrous phthalimide, and chlorinated hydrocarbons, esters, ketones, and ethers.

Examples of the low-molecule crystalline polymeric resins include crystalline polymers having long alkyl side chains, such as acrylate homopolymers, e.g., poly(n-stearyl methacrylate) and poly(n-lauryl methacrylate), and acrylate copolymers, e.g., n-stearyl acrylate-ethyl methacrylate copolymers.

Halogenated hydrocarbons such as halides of the aforementioned branched or linear aliphatic hydrocarbons, e.g., fluorocarbons, are also usable.

The charge director contained in the carrier described above is then explained.

The charge director for negatively electrifiable toner particles, which is present in the carrier liquid, is an ionic or nonionic charge director capable of forming micelles. Examples of this charge director include phospholipids, oil-soluble petroleum sulfonates, ionic or nonionic surfactants, block or graft copolymers comprising a lipophilic part and a hydrophilic part, and compounds having a polymeric chain in a circular or star form, a dendritic form (dendrimer), etc. Of these, phospholipids and oil-soluble petroleum sulfonates are especially preferred, because these compounds not only are thermally stable to conditions under which the liquid developer is heated and to various thermal histories but also function to stabilize ions when a charge control agent having the structure of salt is used, thereby attaining stable dispersibility. Also advantageously used are synthetic polymers, e.g., block or graft copolymers comprising a lipophilic part and a hydrophilic part, because removal of impurities is relatively easy with these compounds.

More specifically, preferred examples of the charge director include phospholipids such as lecithin and cephalin, oil-soluble petroleum sulfonates such as Basic Barium Petronate, Basic Sodium Petronate, and Basic Calcium Petronate manufactured by Witoco Chemical Corp., and polybutylene/succinimide copolymers such as OLOA-1200 manufactured by Schebron Co.

The charge director for positively electrifiable toner particles, which is present in the carrier liquid, is an ionic or nonionic charge director capable of forming micelles. Examples of this charge director include ionic or nonionic surfactants, block or graft copolymers comprising a lipophilic part and a hydrophilic part, and compounds having a polymeric chain in a circular or star form, or a dendritic form (dendrimer), etc. These compounds not only are thermally stable to conditions under which the liquid developer is heated and to various thermal histories but also function to stabilize ions when a charge control agent having the structure of salt is used for the toner, thereby attaining stable dispersibility.

These charge directors for positively electrifiable toner particles may be used in combination with a metal soap. Examples of such metal soaps include aluminum tristearate, aluminum distearate, the stearic acid salts of barium, calcium, lead, and zinc, the linolenic acid salts of cobalt, manganese, lead, and zinc, the octanoic acid salts of aluminum, calcium, and cobalt, the oleic acid salts of calcium and cobalt, zinc palmitate, the naphthenic acid salts of calcium, cobalt, manganese, lead, and zinc, and resin acid salts of calcium, cobalt, manganese, lead, and zinc.

Preferred examples of the aforementioned block or graft copolymers comprising a lipophilic part and a hydrophilic part, which copolymers can be used as the charge director incorporated into the carrier for the toner capable of being negatively or positively charged, include those in which the lipophilic part is a polymer of butadiene, isoprene, an alkyl ester of an α,β-ethylenically-unsaturated acid represented by acrylic acid and methacrylic acid, or a similar monomer and the hydrophilic part is a quaternized trialkylamino polymer, a quaternized pyridinium polymer, or the like. Also preferably used are block copolymers of polyethylene glycol and polypropylene glycol. These block or graft copolymers comprising a lipophilic part and a hydrophilic part have a number-average molecular weight of about from 1,000 to 50,000 as a whole. In the block copolymers, the block arrangement may be any of the AB, ABA, and BAB types. The graft copolymers may have a comb-shaped grafting structure.

The charge director for positively electrifiable toner particles may also be a compound having a polymeric chain such as a cyclic polymer, e.g., a crown ether, a macrocyclic amine, or polynorbornene, a styrene star polymer, or a dendritic polymer (dendrimer) such as polyalkylamideArpolol.

Examples of the ionic or nonionic surfactants are as follows. Examples of anionic surfactants include alkylbenzenesulfonic acid salts, alkylphenylsulfonic acid salts, alkylnaphthalenesulfonic acid salts, higher fatty acid salts, sulfuric acid ester salts of higher fatty acid esters, and sulfonic acid of higher fatty acid esters. Examples of cationic surfactants include primary to tertiary amines and quaternary ammonium salts. Examples of nonionic surfactants include polyoxyethylene nonylphenyl ether, polyoxyethylene octylphenyl ether, polyoxyethylene dodecylphenyl ether, polyoxyethylene alkyl ethers, polyoxyethylene fatty acid esters, sorbitan fatty acid esters, polyoxyethylene sorbitan fatty acid esters, and fatty acid alkylolamides.

These charge directors are used in an amount of desirably from 0.01 to 20% by weight, preferably from 0.05 to 10% by weight, especially preferably from 0.1 to 10% by weight, based on the amount of the solid components of the toner.

The reasons for this are as follows. If the charge director amount is smaller than 0.01% by weight, the desired charge control effect cannot be produced sufficiently. If the amount thereof exceeds 20% by weight, the electrical conductivity of the liquid developer is increased excessively, making it difficult to use the developer. The content of the charge director in the carrier is desirably from 0.01 to 10% by weight, preferably from 0.05 to 1% by weight, based on the amount of the carrier. If the charge director content in the carrier is lower than 0.01% by weight, the desired charge control effect cannot be produced sufficiently. If the content thereof exceeds 10% by weight, the electrical conductivity of the liquid developer is increased excessively, making it difficult to use the developer. The reason why the charge director produces a sufficient charge control effect even when incorporated in a small amount is that the charge director is used in combination with the above-described charge control agent contained in the toner particles.

For the purpose of regulating the properties of the developer, fine polymer particles, inorganic fine particles, or the like may be dispersed besides the charge director. For the purpose of preventing the carrier and the charge director from suffering thermal deterioration, oxidation by light, moisture, etc., or viscosity increase by radical chain, various additives may be dispersed or dissolved into the liquid developer. Examples of antioxidants include 2,2'-methylenebis(4-methyl-6-t-butylphenol), 1,1,3-tris(2-methyl-4-hydroxy-5-t-butylphenyl)butane, dilauryl thiodipropionate, and triphenyl phosphite. Examples of radical polymerization inhibitors include 1,4-dihydroxybenzene, 1,4-naphthoquinone, diphenylpicrylhydrazyl, and N-(3-N-oxyanilino-1,3-dimethylbutylidene)aniline oxide.

In conventional liquid developers, the generally employed technique for charge control is to incorporate a charge control agent into the carrier liquid, and it has been difficult to incorporate a charge control agent into toner particles dispersed in the carrier liquid. Although it is possible to form beforehand toner particles containing a charge control agent and to add the toner particles to a carrier liquid, this method has a drawback that the process is complicated because of the need for steps for toner particle production in addition to the steps for the preparation of the liquid developer. The incorporation of a charge control agent into the toner and the incorporation into the carrier liquid of a charge director capable of being charged oppositely to the charge control agent enable stable electrification over a prolonged time period.

In the present invention, the charge director incorporated in the carrier liquid, which director has a hydrophilic group and a hydrophobic group in the molecule, is thought to be present in the form of micelles in each of which the hydrophilic groups of charge director molecules gather inside with the hydrophobic groups facing outward. It is thought that the size of these micelles varies depending on the degree of the solubility of the charge director in the carrier liquid; charge directors having higher solubilities are thought to form smaller micelles.

The process of the present invention for producing the liquid developer is then explained.

In the first step in the process of the present invention, a colorant, a thermoplastic resin, and a charge control agent are added to and dispersed into an organic solvent (or a carrier liquid). Although these colorant, thermoplastic resin, and charge control agent may be separately dispersed into an organic solvent, use of a masterbatch method is preferred. In the masterbatch method, a colorant/thermoplastic resin mixture having a colorant concentration higher than the desired value is prepared first. The concentration of the pigment or colorant in this masterbatch is preferably from 20 to 40% by weight. The colorant used in this method may be a dry pigment or dye. However, the colorant is preferably a wet cake of a flushed pigment. The most desirable technique is to mix this wet cake with a thermoplastic resin and vaporize and remove the water from the wet cake by heating to thereby displace the water in the wet cake by the resin. This displacement treatment is preferably performed in a vacuum kneader; this attains an improvement in displacement efficiency. The masterbatch thus obtained is then mixed with an additional portion of the thermoplastic resin for pigment concentration regulation and with an organic solvent (carrier) and a charge control agent. In this step, the thermoplastic resin is preferably mixed in such an amount as to result in a pigment concentration in the range of from 10 to 20% by weight. Although the addition of a charge control agent in this step is most desirable from the standpoint of thermal stability, it may be added in the pigment dispersion step described above. In this step for melting and dispersion, the resin, pigment, and charge control agent are completely melted in the organic solvent (carrier). Heating is desirably conducted on an oil bath with stirring, preferably at a temperature not higher than the vaporization temperature of the organic solvent (carrier liquid) and not lower than the melting point of the thermoplastic resin. The heating conditions, which vary depending on the carrier liquid and thermoplastic resin used, include a temperature in the range of from 130° C. to 180° C. and a heating time of about from 10 minutes to 10 hours, preferably about from 30 minutes to 5 hours.

After heating with stirring, the melt is cooled to precipitate toner particles containing both the colorant and the charge control agent therein. Although natural cooling to room temperature suffices for this cooling, a coolant may be used for the cooling. The conditions for stirring during the cooling govern the diameters of the precipitated toner particles. It is preferred to selected stirring conditions so as to result in precipitated toner particles having a diameter of from 10 to 20 μm.

After toner precipitation, the toner particles are wet-ground to regulate the toner so as to have the desired particle diameter. The toner precipitated is preferably ground for about 5 to 40 hours in an attritor using stainless-steel balls of about 1 mm, as a grinding medium while circulating water. This step is continued until the ground toner particles come to have a volume-average particle diameter of from 0.5 to 5 μm and to have a shape in which the thermoplastic resin projects like tentacles. The grinding medium is then removed, and the organic solvent dispersion is concentrated by centrifugal sedimentation or another means preferably to such a degree that the toner concentration in the organic solvent is increased from 1–10% by weight to about 10–25% by weight. After concentration, the same organic solvent is added for dilution to the dispersion with stirring, and a charge director is the added to thereby obtain the liquid developer for electrophotography of the present invention. If desired and necessary, the organic solvent used above may be replaced with another carrier, e.g., a carrier which is solid at ordinary temperature.

In the cooling step, inclusion of the pigment, etc. in the thermoplastic resin occurs satisfactorily. This may be attributable to the strong cohesive force of the resin, which force causes the pigment, etc. present around the resin to come into the resin. Since the order of the degree of polarity for the ingredients is: pigment>resin>carrier medium, it is further thought that cohesive force is present between the pigment and the resin.

At the time of cooling, a solvent for precipitation may be added. Examples of the precipitation solvent include Norpar (trade name for normal paraffins manufactured by Exxon Chemical Co.). Although isoparaffins (isopar) are also usable, Norpar is more advantageously usable because it has a higher boiling point and a lower viscosity. Such a solvent is added for the purposes of controlling the cooling rate during the precipitation operation and of reducing the viscosity of the ink. For toner precipitation, lower solvent viscosities are desirable. Specifically, the precipitation solvent is desirably added in such an amount that the solvent viscosity at the time of precipitation is preferably 50 mPa.s or lower, optimally from 1 to 10 mPa.s. Grinding the precipitated toner particles is not essential, and it is possible to precipitate 0.5 to 5 μm toner particles by regulating the rate of precipitation. However, in order to precipitate toner particles having a diameter of from 0.5 to 5 μm, usable resins are limited because of the strong cohesive force of thermoplastic resins.

Although the process described above is the most desirable for producing the liquid developer of the present invention, any conventionally known method may be used for producing the toner in the liquid developer of the present invention. Examples of such usable known methods include the method described, e.g., in JP-A-58-152258 and the method described in U.S. Pat. No. 4,794,651 (Dec. 27, 1988) to B. Landa et al.

Also usable is a method which comprises weighing out the above-described thermoplastic resin, pigment, and charge control agent in respective amounts in a predetermined proportion, melting the resin by heating, mixing the pigment with the melt to obtain a dispersion, cooling the dispersion, subsequently reducing the cooled dispersion by means of a jet mill, hammer mill, turbo mill, or the like to prepare fine particles, and then dispersing the obtained toner particles to a carrier which has been melted by heating.

It is also possible to prepare a toner in which a charge control agent is contained in the toner particles by suspension polymerization, emulsion polymerization, dispersion polymerization, or another polymerization method or by coacervation, melt dispersion, or emulsion aggregation. This toner is then similarly dispersed into a carrier which has been melted by heating, thereby producing a liquid developer.

In still another method, the above-described resin, colorant, charge control agent, and carrier as raw materials are dispersed and kneaded using an appropriate apparatus at a temperature at which the resin can be plasticized but the carrier does not boil and which is lower than the decomposition point of the resin, charge control agent, and/or colorant. More particularly, this method may be accomplished by heating and melting the pigment, resin, and charge control agent in the carrier by means of a meteoric mixer, a kneader, or the like, and cooling the melt with stirring to thereby solidify and precipitate toner particles based on the temperature dependence of the solvent solubility of the resin.

In a further usable method, the raw materials described above are introduced into an appropriate vessel equipped with a particulate grinding medium for dispersion and kneading, e.g., an attritor or a heated oscillating mill such as a heated ball mill, and the raw materials are dispersed and kneaded in the vessel while heating the vessel at a temperature in a preferred range, e.g., from 80° to 160° C. Preferred materials of the particulate grinding medium include steels such as stainless-steel and carbon steel, alumina, zirconia, and silica.

In producing a toner by the above-described method, the raw materials which have been sufficiently fluidized beforehand are dispersed further within the vessel by means of the particulate grinding medium, and the system is then gradually cooled to around the melting point of the carrier to precipitate toner particles containing both the colorant and the charge control agent from the carrier. It is important that the particulate grinding medium be kept in motion throughout and after the cooling to apply shearing and/or impact to the contents to thereby reduce the toner particle diameters.

The concentration of the toner in the liquid developer is from 0.1 to 15% by weight, preferably from 0.5 to 2% by weight.

The particulate toner produced by any of the above-described methods should have a volume-average particle diameter, as measured with a particle size distribution analyzer of the centrifugal sedimentation type, of from 0.5 to 5 μm. If the volume-average particle diameter of the toner is smaller than 0.5 μm, the rate of deposition of this toner is so low that the developer is not applicable to high-speed copying. If the volume-average particle diameter thereof is larger than 5 μm, desired high-quality images cannot be obtained.

The toner particles may have a shape having many fibers according to need. The "shape having fibers" herein means a shape of toner particles which has fibers, tendrils, tentacles, or the like.

The process for image formation of the present invention is then explained. In the image formation process of the present invention, the step of forming a latent image on a latent-image-holding substrate may be carried out by a known method employed in electrophotography or electrostatic recording. The latent-image-holding substrate may be either an electrophotographic photoreceptor or a dielectric.

The step of developing the latent image formed in the above step may also be carried out by a known method in which a liquid developer is used. In the case where the liquid developer used contains a carrier which is solid at ordinary temperature, the development should be performed while heating the liquid developer.

An image formation process involving the above-described development step is explained by reference to FIG. 1, in which a long photoreceptor is shown for convenience and the steps are applied thereto successively.

In the charging step, a photoreceptor (1) is evenly charged, e.g., positively, by an appropriate charging means, e.g., a corona charging device (2). In the subsequent exposure step, the positive charges on an image-information part are neutralized by an appropriate exposure means, e.g., a semiconductor infrared laser beam (3). In the subsequent development step, the thus-formed electrostatic latent image moves on a developer tank (4). The developer tank (4) contains a liquid developer for electrostatic latent images which is a dispersion of negatively charged toner particles (6) in an electrically insulating carrier (5) which is solid at ordinary temperature; this liquid developer is kept molten by heating with a heating means (7). The developer fed to the developer tank (4) is a dispersion of toner particles, a charge director, etc. in an electrically insulating carrier (5) which is solid at at least ordinary temperature and which liquefies/solidifies upon heating/cooling, and the carrier is one selected from materials satisfying the above-described relationship, i.e., $$\text{room temperature} < T1 < T < T2$$

The toner image thus formed is then transferred to receiving paper (8) by means a transfer roll (9).

The present invention will be explained below by reference to Examples and Comparative Examples, but the invention should not be construed as being limited to these Examples. In the Examples and Comparative Examples, all parts are by weight.

EXAMPLE 1

| | | |
|---|---|---|
| 1. | Ethylene (89%)-methacrylic acid (11%) copolymer: (Newcrel N699, manufactured by E.I. du Pont de Neumours and Co.) | 40 parts |
| 2. | Copper phthalocyanine pigment: (Cyanine Blue 4933M, manufactured by Dainichiseika Color & Chemicals Mfg. Co., Ltd., Japan) | 8 parts |
| 3. | Charge control agent: Aluminum complex of 3,5-di-t-butylsalicylic acid (the compound represented by formula (1) wherein $M_1$ = Al, $R_3$ = $R_4$ = t-butyl, and X = H) | 2 parts |
| 4. | Norpar 15 (manufactured by Exxon Chemical Co.) | 100 parts |

A mixture of the above ingredients was introduced into a stainless-steel beaker, and then continuously stirred for 1 hour with heating at 120° C. on an oil bath to prepare a homogeneous melt containing the completely molten resin, the pigment, and the charge control agent. The melt obtained was gradually cooled to room temperature with stirring, and 100 parts of Norpar 15 was further added. As the temperature of the system lowered, toner particles precipitated which had a particle diameter of from 10 to 20 μm and contained the pigment and the negative-charge control agent therein. The precipitated toner was introduced into a 01 type attritor (manufactured by Mitsui Miike Engineering Corp., Japan) in an amount of 100 g, and was ground for about 20 hours at a rotor speed of 300 rpm using steel balls having a diameter of 0.8 mm. This grinding was continued until the toner came to have a volume-average particle diameter of 2.5 μm, while the particle diameter was monitored with a particle size distribution analyzer of the centrifugal sedimentation type (SA-CP4L, manufactured by Shimadzu Corp., Japan).

Twenty parts of the thus-obtained concentrated toner (toner concentration, 18% by weight) was diluted with 160 parts of eicosane ($C_{20}H_{42}$; melting point, 36.8° C.) which had been melted by heating at 75° C., so as to result in a liquid developer having a toner concentration of 2% by weight. The diluted toner was sufficiently stirred. To the liquid mixture obtained was added Basic Barium Petronate as a charge director in an amount of 0.1 part by weight per part of the toner in the developer. This mixture was sufficiently stirred and then transferred to a stainless-steel vat to produce a liquid developer. The amount of deposited toner in development was measured in a 40° C. atmosphere, with the developer and the whole measuring system being placed therein.

EXAMPLE 2

A concentrated toner was produced in the same manner as in Example 1, except that potassium tetraphenylborate (represented by formula (4) wherein $R_7$=$R_8$=H and X=K) was used in place of the charge control agent used in Example 1. This toner was similarly diluted with 160 parts by weight of triacontane ($C_{30}H_{62}$; melting point, 65.8° C.) which had been melted by heating at 75° C., and the diluted toner was sufficiently stirred. To the liquid mixture obtained was then added-Basic Sodium Petronate (BSP) as a charge director in the same proportion as in Example 1. This mixture was sufficiently stirred to produce a liquid developer.

EXAMPLE 3

A concentrated toner was produced in the same manner as in Example 1, except that the compound represented by formula (3) wherein $M_2$=Cr, X=Y=Z=hydrogen, and A=hydrogen was used in place of the charge control agent used in Example 1 and that carbon black (Carbon Black #4000 manufactured by Mitsubishi Chemical Industries Ltd., Japan) was used as a pigment. This toner was then dispersed into Paraffin Wax 120 (manufactured by Nippon Seiro Co., Ltd., Japan; melting point, about 50° C.) which had been melted by heating at 100° C., in such a proportion as to result in a toner concentration of 2% by weight. To the liquid mixture obtained was added soybean lecithin as a charge director in the same proportion as in Example 1. This mixture was sufficiently stirred to produce a liquid developer.

EXAMPLE 4

| | | |
|---|---|---|
| 1. | Polyester resin (polyester resin obtained by polymerizing terephthalic acid with ethylene oxide adduct of bisphenol A and having a weight-average molecular weight ($M_w$) of 12,000, acid value of 5, and softening point of 110° C.) | 85 parts |
| 2. | Magenta pigment (Carmine 6B, manufactured by Dainichiseika Color & Chemicals Mfg. Co., Ltd.) | 15 parts |
| 3. | Charge control agent (boron complex of 3,5-di-t-butylcatechol; the compound represented by formula (2) wherein $M_1$ = B, $R_{3\ to\ R6}$ = t-butyl, and X = K) | 2 parts |

A mixture of the above ingredients was kneaded in an extruder, subsequently pulverized with a jet mill, and then classified with an air classification device to prepare a toner having an average particle diameter of 3 μm.

This powdery toner was diluted with 160 parts of pentacosane ($C_{25}H_{52}$; melting point, 53.7° C.) which had been melted by heating at 75° C., to such a degree as to result in a toner concentration of 2% by weight. To this liquid mixture was then added dioctyl sodium sulfosuccinate as a charge director in the same proportion as in Example 1. This mixture was sufficiently stirred to produce a liquid developer.

EXAMPLE 5

A toner was produced and diluted with elcosane in the same manner as in Example 1, except that Pigment Yellow 17 (manufactured by Dainichiseika Color & Chemicals Mfg. Co., Ltd.) was used as a pigment. To the liquid mixture obtained was then added Basic Barium Petronate as a charge director in the same amount as in Example 1. This mixture was sufficiently stirred to produce a liquid developer.

EXAMPLE 6

A concentrated toner was produced in the same manner as in Example 1, except that aluminum distearate was used in place of the charge control agent used in Example 1. This toner was similarly diluted with 160 parts by weight of butyl 12-hydroxystearate (melting point, 50° C.) which had been melted by heating at 75° C. To the liquid mixture obtained was then added Basic Sodium Petronate (BSP) as a charge director in the same proportion as in Example 1. This mixture was sufficiently stirred to produce a liquid developer.

EXAMPLE 7

The base toner used in Example 1 was used. As a charge director was used the following ionic copolymer.

An A-B type diblock copolymer obtained from lauryl methacrylate (A) and a monomer (B) formed by quaternizing 4-vinylpyridine with methyl p-toluenesulfonate (number-average molecular weight of block A,8,000; number-average molecular weight of block B, 2,000; degree of chloride-quaternization, 98%). This charge director was added in the same manner as in Example 1 to produce a liquid mixture.

EXAMPLE 8

The base toner used in Example 1 was used. A nonionic surfactant having a chemical structure represented by the formula $$C_{16}H_{33}—O(CH_2CH_2O)_6—H$$

was added thereto as a charge director in the same manner as in Example 1 to produce a liquid developer.

Comparative Example 1

A liquid developer was produced in the same manner as in Example 1, except that the incorporation of a charge control agent into the toner composition and the incorporation of a charge director into the liquid mixture were omitted.

Comparative Example 2

A liquid developer was produced in the same manner as in Example 1, except that the charge director was not used.

Comparative Example 3

To the liquid developer obtained in Comparative Example 1 was added a charge director in the same manner as in Example 1. Thus, a liquid developer was produced.

Comparative Example 4

A toner was produced in the same manner as in Example 1, except that the incorporation of a charge control agent into the toner composition was omitted. One part by weight of aluminum 3,5-di-t-butylsalicylate as a charge director was dissolved into 100 parts of eicosane with heating, and this solution was added to the toner in an amount of 0.1 part in terms of charge director amount per part of the toner in the developer in the same manner as in Example 1. This mixture was sufficiently stirred to produce a liquid developer.

Comparative Example 5

Basic Barium Petronate was added, in the same manner as in Example 1, to the developer used in Comparative Example 4 to produce a liquid developer.

[Evaluation Tests for Liquid Developers]

Figure 2:
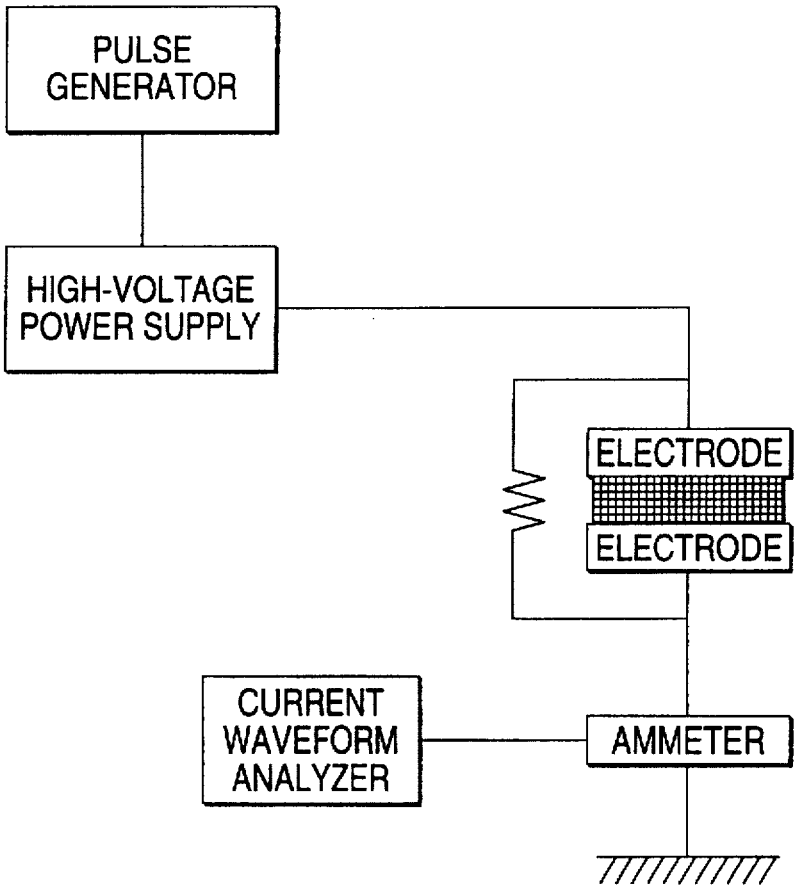
FIG. 2 is a circuit diagram of the apparatus used for measuring the amount of the toner deposited from each of the liquid developers produced in Examples and Comparative Examples.

(1) Examination of polarity of charged developer toner and measurement of the amount of correctly charged toner and the amount of reversely charged toner to the correctly charged toner (hereinafter referred to "incorrectly charged toner"):

The space between flat electrodes having a diameter of 10 cm and disposed in parallel at a distance of 1 mm, (electrode area, 78 $cm^2$) was filled with 3 ml of a liquid developer. A voltage of 1,000 V was applied thereto for 1 second so as to produce an electric field of $+10^4$ V/cm. Thereafter, the electrode on which toner particles had deposited was placed into a vacuum dryer, where the deposit was dried at 120° C. for 2 hours to completely remove the carrier liquid. The amount of the correctly charged toner was determined from the difference between the electrode weight before deposition and that after deposition. The same procedure as the above was conducted, except that the polarity of the applied voltage was reversed (electric field, $-10^4$ V/cm), to measure the amount of the incorrectly charged toner. A circuit diagram of the apparatus used for these toner amount measurements is shown in FIG. 2.

(2) Image quality evaluation:

FIG. 1 schematically shows an apparatus for image formation and evaluation.

As described hereinabove, the developer used is placed in a developer tank (4). When the liquefied developer comes into contact with a photoreceptor, toner particles (6) are attracted to the charged part of the photoreceptor to conduct development. In the final fixing step, the toner image is fixed to receiving paper (8) to form an image.

During the development, if the toner attracted to the photoreceptor (1) solidifies immediately after contact of the photoreceptor (1) with the developer, there is a fear of giving a low-quality image. Therefore, a heating means may be disposed also for heating either the photoreceptor itself or the stage for fixing the photoreceptor.

The developer compositions for Examples 1 to 8 and those for Comparative Examples 1 to 5 are shown in Tables 1 and 2, respectively. The evaluation results obtained are shown in Table 3.

TABLE 1

| | Toner composition | | | Carrier composition | | Polarity |
|---|---|---|---|---|---|---|
| | Toner resin | Pigment | Charge control agent | Carrier liqiud | Charge director | of charged toner |
| Ex. 1 | ethylene/ methacrylic acid co-polymer | copper phthalo-cyanine | aluminum com-plex of 3,5-di-t-butylsali-cylic acid | eicosane | Basic Barium Petronate | negative |
| Ex. 2 | ethylene/ methacrylic acid co-polymer | copper phthalo-cyanine | potassium salt of tetraphenyl-borate | triacontane | Basic Sodium Petronate | negative |
| Ex. 3 | ethylene/ methacrylic acid co-polymer | Carbon Black #4000 | compound of formula (3) where $M_2$ = Cr, X = Y = Z = H, A = H | Paraffin Wax 120 | soybean lecithin | negative |

TABLE 1-continued

| | Toner composition | | | Carrier composition | | Polarity |
|---|---|---|---|---|---|---|
| | Toner resin | Pigment | Charge control agent | Carrier liqiud | Charge director | of charged toner |
| Ex. 4 | polyester resin | Carmine 6B | boron complex of 3,5-di-t-butylcatechol | penta-cosane | dioctyl sodium sulfo-succinate | negative |
| Ex. 5 | ethylene/ methacrylic acid co-polymer | Pigment Yellow 17 | aluminum com-plex of 3,5-di-t-butylsali-cylic acid | eicosane | Basic Barium Petronate | negative |
| Ex. 6 | ethylene/ methacrylic acid co-polymer | copper phthalo-cyanine | aluminum distearate | butyl 12-hydroxy-stearate | Basic Sodium Petronate | negative |
| Ex. 7 | ethylene/ methacrylic acid co-polymer | copper phthalo-cyanine | aluminum com-plex of 3,5-di-t-butylsali-cylic acid | eicosane | A-B type diblock copolymer | negative |
| Ex. 8 | ethylene/ methacrylic acid co-polymer | copper phthalo-cyanine | aluminum com-plex of 3,5-di-t-butylsali-cylic acid | eicosane | nonionic surfac-tant | negative |

TABLE 2

| | Toner composition | | | Carrier composition | | Polarity |
|---|---|---|---|---|---|---|
| | Toner resin | Pigment | Charge control agnet | Carrier liquid | Charge director | of charged toner |
| Comp. Ex. 1 | ethylene/ methacrylic acid co-polymer | copper phthalo-cyanine | none | eicosane | none | neither positive nor negative |
| Comp. Ex. 2 | ethylene/ methacrylic acid co-polymer | copper phthalo-cyanine | aluminum complex of 3,5-di-t-butylsali-cylic acid | eicosane | none | neither positive nor negative |
| Comp. Ex. 3 | ethylene/ methacrylic acid co-polymer | copper phthalo-cyanine | none | eicosane | Basic Barium Petronate | weakly negative |
| Comp. Ex. 4 | ethylene/ methacrylic acid co-polymer | copper phthalo-cyanine | none | eicosane | aluminum complex of 3,5-di-t-butylsali-cylic acid | neither positive nor negative |
| Comp. Ex. 5 | ethylene/ methacrylic acid co-polymer | copper phthalo-cyanine | none | eicosane | aluminum complex of 3,5-di-t-butylsali-cylic acid and Basic Barium Petronate | both positive and negative |

TABLE 3

| | Amount of Correctly Charged Toner | | Amount of Incorrectly Charged Toner | |
|---|---|---|---|---|
| | Immediately after preparation (mg) | 7 Days after preparation (mg) | Immediately after preparation (mg) | 7 Days after preparation (mg) |
| Ex. 1 | 29.9 | 27.0 | 0.1 | 0.0 |
| Ex. 2 | 25.1 | 25.0 | 0.0 | 0.1 |
| Ex. 3 | 30.6 | 28.2 | 0.1 | 0.1 |

TABLE 3-continued

| | Amount of Correctly Charged Toner | | Amount of Incorrectly Charged Toner | |
|---|---|---|---|---|
| | Immediately after preparation (mg) | 7 Days after preparation (mg) | Immediately after preparation (mg) | 7 Days after preparation (mg) |
| Ex. 4 | 34.5 | 31.2 | 0.1 | 0.1 |
| Ex. 5 | 26.3 | 24.2 | 0.1 | 0.1 |
| Ex. 6 | 28.8 | 19.1 | 0.2 | 0.2 |

TABLE 3-continued

| | Amount of Correctly Charged Toner | | Amount of Incorrectly Charged Toner | |
|---|---|---|---|---|
| | Immediately after preparation (mg) | 7 Days after preparation (mg) | Immediately after preparation (mg) | 7 Days after preparation (mg) |
| Ex. 7 | 32.9 | 32.8 | 0.1 | 0.1 |
| Ex. 8 | 36.4 | 32.8 | 0.1 | 0.1 |
| Comp. Ex. 1 | 0.3 | 0.1 | 0.1 | 0.2 |
| Comp. Ex. 2 | 0.8 | 0.2 | 0.1 | 0.3 |
| Comp. Ex. 3 | 10.3 | 8.8 | 3.5 | 6.1 |
| Comp. Ex. 4 | 0.5 | 0.1 | 0.2 | 1.2 |
| Comp. Ex. 5 | 8.6 | 6.1 | 8.3 | 4.9 |

The developers obtained in Examples 1 to 8 showed satisfactory negatively electrifiable toner characteristics with a reduced amount of incorrectly charged toner. The deposited toner amounts for these developers were also stable even at 7 days after developer preparation. The toners of Comparative Examples 1, 2, and 4 were charged neither positively nor negatively. The deposited toner amounts for the developer of Comparative Example 3 were not larger than ½ of those for the developer of Example 1, and were instable in that the amount of incorrectly charged toner increased at 7 days after developer preparation. The deposited toner amounts for the developer of Comparative Example 5 were not larger than ½ of those for the developer of Example 2, and the amounts of incorrectly charged toner were also large. The deposited toner amounts were instable in that the amount of incorrectly charged toner increased at 7 days after developer preparation.

EXAMPLE 9

An image was actually formed and evaluated using the above-described apparatus for image formation and evaluation. The liquid developer of Example 1 was used to form an image while maintaining the temperature of the liquid developer at 75° C. The image obtained was a satisfactory one having high resolution. Furthermore, the liquid developer of Example 1 was stored for 2,000 hours and then used to conduct 200-sheet continuous copying. As a result, satisfactory images equal to the initial ones were obtained after 100th-sheet copying. These images were completely free from the odor of an organic solvent.

Comparative Example 6

The same image evaluation was conducted using the above-described apparatus for image formation and evaluation. The liquid developer of Comparative Example 1 was used to form an image while maintaining the temperature of the liquid developer at 75° C. The image obtained had a low image density and poor quality. This liquid developer was used to conduct 200-sheet continuous copying. As a result, the image quality declined further to a considerably unsatisfactory level.

EXAMPLE 10

| | | |
|---|---|---|
| 1. | Ethylene (89%)-methacrylic acid (11%) copolymer: (Newcrel N699, manufactured by E.I. du Pont de Neumours and Co.) | 40 parts |
| 2. | Copper phthalocyanine pigment: (Cyanine Blue 4933M, manufactured by Dainichiseika Color & Chemicals Mfg. Co., Ltd.) | 8 parts |
| 3. | Charge control agent: Aluminum salt of 3,5-di-t-butylsalicylic acid (the compound represented by formula (1) wherein $M_1$ = Al, $R_3$ = $R_4$ = t-butyl, and X = H) | 2 parts |
| 4. | Norpar 15 (manufactured by Exxon Chemical Co.) | 100 parts |

A mixture of the above ingredients was introduced into a stainless-steel beaker, and then continuously stirred for 1 hour with heating at 120° C. on an oil bath to prepare a homogeneous melt containing the completely molten resin, the pigment, and the charge control agent. The melt obtained was gradually cooled to room temperature with stirring, and 100 parts of Norpar 15 was further added. As the temperature of the system lowered, toner particles precipitated which had a particle diameter of from 10 to 20 μm and contained the pigment and the negative-charge control agent therein. The precipitated toner was introduced into a 01 type attritor (manufactured by Mitsui Miike Engineering Corp.) in an amount of 100 g, and was ground for about 20 hours at a rotor speed of 300 rpm using steel balls having a diameter of 0.8 mm. This grinding was continued until the toner came to have a volume-average particle diameter of 2.5 μm, while the particle diameter was monitored with a particle size distribution analyzer of the centrifugal sedimentation type (SA-CP4L, manufactured by Shimadzu Corp.).

Twenty parts of the thus-obtained concentrated toner (toner concentration, 18% by weight) was diluted with 160 parts of propylene glycol butyl octyl ether, so as to result in a liquid developer having a toner concentration of 2% by weight. The diluted toner was sufficiently stirred. To the liquid mixture obtained was added Basic Barium Petronate (BBP) as a charge director in an amount of 0.1 part per part of the toner in the liquid developer. This mixture was sufficiently stirred to produce a liquid developer.

EXAMPLE 11

A concentrated toner was produced in the same manner as in Example 10, except that potassium tetraphenylborate (represented by formula (4) wherein $R_7$=$R_8$=H and X=K) was used in place of the charge control agent used in Example 10. This toner was similarly diluted with propylene glycol butyl octyl ether. To the liquid mixture obtained was then added Basic Sodium Petronate (BSP) as a charge director in the same proportion as in Example 10. This mixture was sufficiently stirred to produce a liquid developer.

EXAMPLE 12

A concentrated toner was produced in the same manner as in Example 10, except that the compound represented by formula (3) wherein $M_2$=Cr, X=Y=Z=hydrogen, and A=hydrogen was used in place of the charge control agent used in Example 10 and that carbon black (Carbon Black #4000, manufactured by Mitsubishi Chemical Industries Ltd.) was used as a pigment. This toner was similarly diluted with dioctyl ether. To the liquid mixture obtained was then added soybean lecithin as a charge director in the same proportion as in Example 10. This mixture was sufficiently stirred to produce a liquid developer.

EXAMPLE 13

| | | |
|---|---|---|
| 1. | Polyester resin (polyester resin obtained by polymerizing terephthalic acid with ethylene oxide adduct of bisphenol A and having a weight-average molecular weight ($M_w$) of 12,000, acid value of 5, and softening point of 110° C.) | 85 parts |
| 2. | Magenta pigment (Carmine 6B, manufactured by Dainichiseika Color & Chemicals Mfg. Co., Ltd.) | 15 parts |
| 3. | Charge control agent (boron complex of 3,5-di-t-butylcatechol; the compound represented by formula (2) wherein $M_1$ = B, $R_3$ to $R_6$ = t-butyl, and X = K) | 2 parts |

A mixture of the above ingredients was kneaded in an extruder, subsequently pulverized with a jet mill, and then classified with an air classification device to prepare a toner having an average particle diameter of 3 μm.

This powdery toner was dispersed into dioctyl ether to such a proportion as to result in a toner concentration of 2% by weight. To this liquid mixture was then added dioctyl sodium sulfosuccinate as a charge director in the same proportion as in Example 10. This mixture was sufficiently stirred to produce a liquid developer.

EXAMPLE 14

A toner was produced and diluted with propylene glycol butyl octyl ether in the same manner as in Example 10, except that Pigment Yellow 17 (manufactured by Dainichiseika Color & Chemicals Mfg. Co., Ltd.) was used as a pigment.

To the liquid mixture obtained was then added Basic Barium Petronate as a charge director in the same amount as in Example 10. This mixture was sufficiently stirred to produce a liquid developer.

EXAMPLE 15

A concentrated toner was produced in the same manner as in Example 10, except that aluminum distearate was used in place of the charge control agent used in Example 10. This toner was similarly diluted with dioctyl ether. To the liquid mixture obtained was then added Basic Sodium Petronate (BSP) as a charge director in the same proportion as in Example 10. This mixture was sufficiently stirred to produce a liquid developer.

EXAMPLE 16

The base toner used in Example 10 was used. As a charge director was used the following ionic copolymer.

An A-B type diblock copolymer obtained from lauryl methacrylate (A) and a monomer (B) formed by quaternizing 4-vinylpyridine with methyl p-toluenesulfonate (number-average molecular weight of block A, 8,000; number-average molecular weight of block B, 2,000; degree of quaternization, 98%).

This charge director was added in the same manner as in Example 10 to produce a liquid developer.

EXAMPLE 17

The concentrated toner used in Example 10 was used. A nonionic surfactant having a chemical structure represented by the formula $$C_{16}H_{33}—O(CH_2CH_2O)_6—H$$

was added thereto as a charge director in the same manner as in Example 10 to produce a liquid developer.

Comparative Example 7

A liquid developer was produced in the same manner as in Example 10, except that the incorporation of a charge control agent into the toner composition and the incorporation of a charge director into the liquid mixture were omitted.

Comparative Example 8

A liquid developer was produced in the same manner as in Example 10, except that the charge director was not used.

Comparative Example 9

To the liquid developer obtained in Comparative Example 7 was added a charge director in the same manner as in Example 10. Thus, a liquid developer was produced.

Comparative Example 10

A toner was produced in the same manner as in Example 10, except that the incorporation of a charge control agent into the toner composition was omitted. One part of aluminum 3,5-di-t-butylsalicylate as a charge director was dissolved into 100 parts of propylene glycol butyl octyl ether with heating, and this solution was added to the toner in an amount of 0.1 part in terms of charge director amount per part of the toner in the liquid developer in the same manner as in Example 10. This mixture was sufficiently stirred to produce a liquid developer.

Comparative Example 11

Basic Barium Petronate was added, in the same manner as in Example 10, to the developer used in Comparative Example 10 to produce a liquid developer.

The developer compositions for Examples 10 to 17 and those for Comparative Examples 7 to 11 are shown in Tables 4 and 5, respectively. The evaluation results obtained are shown in Table 6.

TABLE 4

| | Toner composition | | | Carrier composition | | Polarity |
|---|---|---|---|---|---|---|
| | Toner resin | Pigment | Charge control agnet | Carrier liquid | Charge director | of charged toner |
| Ex. 10 | ethylene/ methacrylic acid co-polymer | copper phthalo-cyanine | aluminum com-plex of 3,5-di-t-butylsali-cylic acid | propylene glycol butyl octyl ether | Basic Barium Petronate | negative |

TABLE 4-continued

| | Toner composition | | | Carrier composition | | Polarity |
|---|---|---|---|---|---|---|
| | Toner resin | Pigment | Charge control agnet | Carrier liquid | Charge director | of charged toner |
| Ex. 11 | ethylene/ methacrylic acid co-polymer | copper phthalo-cyanine | potassium salt of tetraphenyl-borate | propylene glycol butyl octyl ether | Basic Sodium Petronate | negative |
| Ex. 12 | ethylene/ methacrylic acid co-polymer | Carbon Black #4000 | compound of formula (3) where $M_2$ = Cr, X = Y = Z = H, A = H | dioctyl ether | soybean lecithin | negative |
| Ex. 13 | polyester resin | Carmine 6B | boron complex of 3,5-di-t-butylcatechol | dioctyl ether | dioctyl sodium sulfo-succinate | negative |
| Ex. 14 | ethylene/ methacrylic acid co-polymer | Pigment Yellow 17 | aluminum com-plex of 3,5-di-t-butylsali-cylic acid | propylene glycol butyl octyl ether | Basic Barium Petronate | negative |
| Ex. 15 | ethylene/ methacrylic acid co-polymer | copper phthalo-cyanine | aluminum distearate | dioctyl ether | Basic Sodium Petronate | negative |
| Ex. 16 | ethylene/ methacrylic acid co-polymer | copper phthalo-cyanine | aluminum com-plex of 3,5-di-t-butylsali-cylic acid | propylene glycol butyl octyl ether | A-B type diblock copolymer | negative |
| Ex. 17 | ethylene/ methacrylic acid co-polymer | copper phthalo-cyanine | aluminum com-plex of 3,5-di-t-butylsali-cylic acid | propylene glycol butyl octyl ether | nonionic surfac-tant | negative |

TABLE 5

| | Toner composition | | | Carrier composition | | Polarity |
|---|---|---|---|---|---|---|
| | Toner resin | Pigment | Charge control agnet | Carrier liquid | Charge director | of charged toner |
| Comp. Ex. 7 | ethylene/ methacrylic acid co-polymer | copper phthalo-cyanine | none | propylene glycol butyl octyl ether | none | neither positive nor negative |
| Comp. Ex. 8 | ethylene/ methacrylic acid co-polymer | copper phthalo-cyanine | aluminum complex of 3,5-di-t-butylsali-cylic acid | propylene glycol butyl octyl ether | none | neither positive nor negative |
| Comp. Ex. 9 | ethylene/ methacrylic acid co-polymer | copper phthalo-cyanine | none | propylene glycol butyl octyl ether | Basic Barium Petronate | weakly negative |
| Comp. Ex. 10 | ethylene/ methacrylic acid co-polymer | copper phthalo-cyanine | none | propylene glycol butyl octyl ether | aluminum complex of 3,5-di- t-butylsali-cylic acid | neither positive nor negative |
| Comp. Ex. 11 | ethylene/ methacrylic acid co-polymer | copper phthalo-cyanine | none | propylene glycol butyl octyl ether | aluminum complex of 3,5-di-t-butylsali-cylic acid and Basic Barium Petronate | both positive and negative |

TABLE 6

| | Amount of Correctly Charged Toner | | Amount of Incorrectly Charged Toner | |
|---|---|---|---|---|
| | Immediately after preparation (mg) | 7 Days after preparation (mg) | Immediately after preparation (mg) | 7 Days after preparation (mg) |
| Ex. 10 | 25.5 | 25.0 | 0.1 | 0.0 |
| Ex. 11 | 24.3 | 25.0 | 0.0 | 0.1 |
| Ex. 12 | 32.0 | 31.2 | 0.1 | 0.1 |
| Ex. 13 | 32.0 | 31.2 | 0.1 | 0.1 |
| Ex. 14 | 23.9 | 24.2 | 0.1 | 0.1 |
| Ex. 15 | 33.0 | 32.8 | 0.1 | 0.1 |
| Ex. 16 | 33.0 | 32.8 | 0.1 | 0.1 |
| Ex. 17 | 33.0 | 32.8 | 0.1 | 0.1 |
| Comp. Ex. 7 | 0.1 | 0.1 | 0.1 | 0.1 |
| Comp. Ex. 8 | 0.1 | 0.2 | 0.1 | 0.2 |
| Comp. Ex. 9 | 10.1 | 8.8 | 2.0 | 4.1 |
| Comp. Ex. 10 | 0.2 | 0.1 | 0.2 | 0.2 |
| Comp. Ex. 11 | 8.1 | 6.1 | 5.1 | 6.5 |

The developers obtained in Examples 10 to 17 showed satisfactory negatively electrifiable toner characteristics with a reduced amount of incorrectly charged toner. The deposited toner amounts for these developers were also stable even at 7 days after developer preparation. The toners of Comparative Examples 7, 8, and 10 were charged neither positively nor negatively. The deposited toner amounts for the developer of Comparative Example 9 were not larger than ½ of those for the developer of Example 10, and were instable in that the amount of incorrectly charged toner increased at 7 days after developer preparation. The deposited toner amounts for the developer of Comparative Example 11 were not larger than ½ of those for the developer of Example 11, and the amounts of incorrectly charged toner were also large. The deposited toner amounts were instable in that the amount of incorrectly charged toner increased at 7 days after developer preparation.

EXAMPLE 18

The concentrated toner used in Example 10 was diluted with a carrier liquid which was a 50:50 by weight mixture of diethylene glycol dibutyl ether and Norpar 15 (Exxon Chemical Co.), to such a degree as to result in a solid concentration of 2% by weight. To the diluted toner was added a charge director in the same manner as in Example 10. Thus, a liquid developer having a toner concentration of 2% by weight was produced.

EXAMPLE 19

The concentrated toner used in Example 10 was diluted with a carrier liquid which was a 50:50 by weight mixture of diethylene glycol dibutyl ether and isopar L (Exxon Chemical Co.), to such a degree as to result in a solid concentration of 2% by weight. To the diluted toner was added a charge director in the same manner as in Example 10. Thus, a liquid developer having a toner concentration of 2% by weight was produced.

EXAMPLE 20

Twenty parts of the concentrated toner used in Example 10 (toner concentration, 18% by weight) was diluted with a mixture of 80 parts of eicosane ($C_{20}H_{42}$; melting point, 36.8° C.) and 80 parts by weight of diethylene glycol dibutyl ether which mixture had been melted by heating at 75° C., to such a degree as to result in a liquid developer having a toner concentration of 2% by weight. The diluted toner was sufficiently stirred. Basic Barium Petronate was added thereto as a charge director in the same manner as in Example 10 in an amount of 0.1 part per part of the toner in the developer. This mixture was sufficiently stirred and then transferred to a stainless-steel vat to produce a liquid developer. The amount of deposited toner in development was measured in a 40° C. atmosphere, with the whole measuring system being placed therein.

EXAMPLE 21

The concentrated toner used in Example 10 was diluted with Norpar 15 carrier liquid to such a degree as to result in a solid concentration of 2% by weight. A charge director was added thereto in the same manner as in Example 10 to produce a liquid developer having a toner concentration of 2% by weight.

The developer compositions for Examples 18 to 21 and the evaluation results obtained are shown in Tables 7 and 8, respectively.

TABLE 7

| | Toner composition | | | Carrier composition | | | Polarity |
|---|---|---|---|---|---|---|---|
| | Toner resin | Pigment | Charge control agnet | Carrier liquid | Mixing ratio | Charge director | of charged toner |
| Ex. 18 | ethylene/ methacrylic acid copolymer | copper phthalo-cyanine | aluminum complex of 3,5-di-t-butylsali-cyclic acid | mixture of diethylene glycol di-butyl ether and Norpar 15 | 50:50 | Basic Barium Petronate | negative |
| Ex. 19 | ethylene/ methacrylic acid copolymer | copper phthalo-cyanine | aluminum complex of 3,5-di-t-butylsali-cyclic acid | mixture of diethylene glycol di-butyl ether and Isopar L | 50:50 | Basic Barium Petronate | negative |

TABLE 7-continued

| | Toner composition | | | Carrier composition | | | Polarity |
|---|---|---|---|---|---|---|---|
| | Toner resin | Pigment | Charge control agnet | Carrier liquid | Mixing ratio | Charge director | of charged toner |
| Ex. 20 | ethylene/ methacrylic acid copolymer | copper phthalo-cyanine | aluminum complex of 3,5-di-t-butylsali-cyclic acid | mixture of diethylene glycol di-butyl ether and eicosane | 50:50 | Basic Barium Petronate | negative |
| Ex. 21 | ethylene/ methacrylic acid copolymer | copper phthalo-cyanine | aluminum complex of 3,5-di-t-butylsali-cyclic acid | Norpar 15 | 100 | Basic Barium Petronate | negative |

TABLE 8

| | Amount of Correctly Charged Toner | | Amount of Incorrectly Charged Toner | |
|---|---|---|---|---|
| | Immediately after preparation (mg) | 7 Days after preparation (mg) | Immediately after preparation (mg) | 7 Days after preparation (mg) |
| Ex. 18 | 25.5 | 25.0 | 0.1 | 0.0 |
| Ex. 19 | 26.3 | 24.0 | 0.0 | 0.1 |
| Ex. 20 | 30.0 | 29.2 | 0.1 | 0.1 |
| Ex. 21 | 19.9 | 16.2 | 0.5 | 1.2 |

The developers obtained in Examples 18, 19, and 20 showed satisfactory negatively electrifiable characteristics with a reduced amount of incorrectly charged toner and a large amount of deposited toner. The deposited toner amounts for these developers were also stable even at 7 days after developer preparation. The developer of Example 21 showed negatively electrifiable characteristics with a slightly large amount of incorrectly charged toner. The deposited toner amount for this developer was somewhat small, and decreased slightly at 7 days after developer preparation.

EXAMPLE 22

An image was actually formed and evaluated using a copier (Type FX-5030, manufactured by Fuji Xerox Co., Ltd., Japan) which had been modified by adapting the black development part for liquid developers.

The liquid developer of Example 10 was used to form an image. The image obtained was a satisfactory one having high resolution. Further, this liquid developer was used to conduct 100-sheet continuous copying. As a result, satisfactory images equal to the initial ones were obtained after 100th-sheet copying.

Comparative Example 12

Using the liquid developer of Comparative Example 11, image evaluation was conducted in the same manner as in Example 22. The image obtained was a low-quality one having a large amount of toner deposited on the background. This image was unsatisfactory also in resolution with respect to narrow lines. This liquid developer was used to conduct 100-sheet continuous copying. As a result, the images obtained after 100th-sheet copying had even lower quality than the initial ones.

EXAMPLE 23

| | |
|---|---|
| 1. Ethylene (89%)-methacrylic acid (11%) copolymer: (Newcrel N699, manufactured by E. I. du Pont de Neumours and Co.) | 40 parts |
| 2. Copper phthalocyanine pigment: (Cyanine Blue 4933M, manufactured by Dainichiseika Color & Chemicals Mfg. Co., Ltd.) | 8 parts |
| 3. Charge control agent: Compound 5-(1) (3-laurylamidopropyltrimethyl-ammonium methylsulfate) | 2 parts |
| 4. Norpar 15 (manufactured by Exxon Chemical Co.) | 100 parts |

A mixture of the above ingredients was introduced into a stainless-steel beaker, and then continuously stirred for 1 hour with heating at 120° C. on an oil bath to prepare a homogeneous melt containing the completely molten resin, the pigment, and the charge control agent. The melt obtained was gradually cooled to room temperature with stirring, and 100 parts of Norpar 15 was further added. As the temperature of the system lowered, toner particles precipitated which had a particle diameter of from 10 to 20 μm and contained the pigment and the charge control agent therein.

The precipitated toner was introduced into a 01 type attritor (manufactured by Mitsui Miike Engineering Corp.) in an amount of 100 g, and was ground for about 20 hours at a rotor speed of 300 rpm using steel balls having a diameter of 0.8 mm. This grinding was continued until the toner came to have a volume-average particle diameter of 2.5 μm, while the particle diameter was monitored with a particle size distribution analyzer of the centrifugal sedimentation type (SA-CP4L, manufactured by Shimadzu Corp.).

Twenty parts of the thus-obtained concentrated toner (toner concentration, 18% by weight) was diluted with 160 parts by weight of elcosane ($C_{20}H_{42}$; melting point, 36.8° C.) which had been melted by heating at 75° C., so as to result in a liquid developer having a toner concentration of 2% by weight. The diluted toner was sufficiently stirred. To the liquid mixture obtained was added an aluminum complex of 3,5-di-t-butylsalicylic acid as a charge director in an amount of 0.1 part by weight per part of the toner in the liquid developer. This mixture was sufficiently stirred and then transferred to a stainless-steel vat to prepare a liquid developer. The amount of deposited toner in development was measured in a 40° C. atmosphere, with the developer and the whole measuring system being placed therein.

EXAMPLE 24

A concentrated toner was produced in the same manner as in Example 23, except that Compound 5-(2)

(stearyltriethylammonium naphthosulfonate) was used in place of the charge control agent used in Example 23. This toner was similarly diluted with 160 parts by weight of triacontane ($C_{30}H_{62}$; melting point, 65.8° C.) which had been melted by heating at 75° C., and the diluted toner was sufficiently stirred. To the liquid mixture obtained was then added an aluminum complex of 3,5-di-t-butylsalicylic acid as a charge director in the same proportion as in Example 23. This mixture was sufficiently stirred to produce a liquid developer.

EXAMPLE 25

A concentrated toner was produced in the same manner as in Example 23, except that Compound 5-(3) (stearyldimethylbenzylammonium p-toluenesulfonate) was used in place of the charge control agent used in Example 23 and that carbon black (Carbon Black #4000, manufactured by Mitsubishi Chemical Industries Ltd.) was used as a pigment. This toner was then dispersed into Paraffin Wax 120 (manufactured by Nippon Seiro Co., Ltd.; melting point, about 50° C.) which had been melted by heating at 100° C., in such a proportion as to result in a toner concentration of 2% by weight. To the liquid mixture obtained was added a boron complex of 3,5-di-t-butylcatechol as a charge director in the same proportion as in Example 23. This mixture was sufficiently stirred to produce a liquid developer.

EXAMPLE 26

| | |
|---|---|
| 1. Polyester resin (polyester resin obtained by polymerizing terephthalic acid with ethylene oxide adduct of bisphenol A and having a weight-average molecular weight ($M_w$) of 12,000, acid value of 5, and softening point of 110° C.) | 85 parts |
| 2. Magenta pigment (Carmine 6B, manufactured by Dainichiseika Color & Chemicals Mfg. Co., Ltd.) | 15 parts |
| 3. Charge control agent: Compound 5-(4) | 2 parts |

A mixture of the above ingredients was kneaded in an extruder, subsequently pulverized with a jet mill, and then classified with an air classification device to prepare a This powdery toner was diluted with 160 parts by weight of pentacosane ($C_{25}H_{52}$; melting point, 53.7° C.) which had been melted by heating at 75° C., to such a degree as to result in a toner concentration of 2% by weight. To this liquid mixture was then added dioctyl sodium sulfosuccinate as a charge director in the same proportion as in Example 23. This mixture was sufficiently stirred to produce a liquid developer.

EXAMPLE 27

A toner was produced and diluted with eicosane in the same manner as in Example 23, except that Pigment Yellow 17 (manufactured by Dainichiseika Color & Chemicals Mfg. Co., Ltd.) was used as a pigment. To the liquid mixture obtained was then added an aluminum complex of 3,5-di-t-butylsalicylic acid as a charge director in the same amount as in Example 23. This mixture was sufficiently stirred to produce a liquid developer.

EXAMPLE 28

The concentrated toner used in Example 23 was used. As a charge director was used the following ionic copolymer.

Charge director: copolymer of stearyl methacrylate, methyl methacrylate, and tetrahydroxyethylene methyl methacrylate in a weight ratio of 68/30/2 (number-average molecular weight, 5,000). This charge director was added in the same manner as in Example 23 to produce a liquid developer. Example 23 to produce a liquid developer.

EXAMPLE 29

A toner was produced in the same manner as in Example 23, except that Compound 6-(1) (cetylpyridinium chloride) was used as a charge control agent for the concentrated toner used in Example 23. A nonionic surfactant having the following chemical structure was used as a charge director.

Charge director: $C_{16}H_{33}—O(CH_2CH_2O)_6—H$

This charge director was added in the same manner as in Example 23 to produce a liquid developer.

Comparative Example 13

A toner was produced in the same manner as in Example 23, except that Compound 6-(2) (cetylpyridinium p-toluenesulfonate) was used as a charge control agent for the concentrated toner used in Example 23. A liquid developer was produced from this toner in the same manner as in Example 23, except that a charge director was not added to the liquid mixture.

Comparative Example 14

A liquid developer was produced in the same manner as in Example 23, except that a charge director was not used for the liquid developer used in Example 23.

Comparative Example 15

A toner was produced in the same manner as in Example 23, except that a charge control agent was not added to the toner composition. A charge director was added to the liquid developer in the same manner as in Example 23 to produce a liquid developer.

Comparative Example 16

A toner was produced in the same manner as in Example 23, except that a charge control agent was not added. One part by weight of Compound 5-(2), used as a charge control agent in Example 24, was dissolved into 100 parts by weight of propylene glycol butyl octyl ether with heating, and this solution was added to the toner in an amount of 0.1 part in terms of Compound (2) amount per part of the toner in the liquid developer in the same manner as in Example 1. This mixture was sufficiently stirred to produce a liquid developer.

Comparative Example 17

A aluminum complex of 3,5-di-t-butylsalicylic acid was added, in the same manner as in Example 23, to the developer used in Comparative Example 16 to produce a liquid developer.

Tests for evaluating the above-obtained liquid developers were carried out in the same manner as the above.

During development, if the toner attracted to the photoreceptor (1) solidifies immediately after contact of the photoreceptor (1) with the liquid developer, there is a fear of giving a low-quality image. Therefore, a heating means may be disposed also for heating either the photoreceptor itself or the stage for fixing the photoreceptor. those for Comparative Examples 13 to 17 are shown in Tables 4 and 5, respectively.

The evaluation results obtained are shown in Table 6.

TABLE 4

| | | Toner composition | | Carrier composition | | Polarity |
|---|---|---|---|---|---|---|
| | Toner resin | Pigment | Charge control agnet | Carrier liquid | Charge director | of charged toner |
| Ex. 23 | ethylene/ methacrylic acid co-polymer | copper phthalo-cyanine | Compound 5-(1) | eicosane | aluminum complex of 3,5-di-t-butyl-salicylic acid | positive |
| Ex. 24 | ethylene/ methacrylic acid co-polymer | copper phthalo-cyanine | Compound 5-(2) | triacon-tane | aluminum complex of 3,5-di-t-butylsali-cylic acid | positive |
| Ex. 25 | ethylene/ methacrylic acid co-polymer | Carbon Black #4000 | Compound 5-(3) | Paraffin Wax 120 | boron complex of 3,5-di-t-butyl-catechol | positive |
| Ex. 26 | polyester resin | Carmine 6B | Compound 5-(4) | penta-cosane | dioctyl sodium sulfo-succinate | positive |
| Ex. 27 | ethylene/ methacrylic acid co-polymer | Pigment Yellow 17 | Compound 5-(1) | eicosane | aluminum complex of 3,5-di-t-butylsali-cylic acid | positive |
| Ex. 28 | ethylene/ methacrylic acid co-polymer | copper phthalo-cyanine | Compound 5-(1) | eicosane | ionic polymer | positive |
| Ex. 29 | ethylene/ methacrylic acid co-polymer | copper phthalo-cyanine | Compound 6-(1) | eicosane | nonionic surfactant | positive |

TABLE 5

| | | Toner composition | | Carrier composition | | Polarity |
|---|---|---|---|---|---|---|
| | Toner resin | Pigment | Charge control agnet | Carrier liquid | Charge director | of charged toner |
| Ex. 13 | ethylene/ methacrylic acid co-polymer | copper phthalo-cyanine | Compound 6-(2) | eicosane | none | neither positive nor negative |
| Ex. 14 | ethylene/ methacrylic acid co-polymer | copper phthalo-cyanine | Compound 5-(1) | eicosane | none | neither positive nor negative |
| Ex. 15 | ethylene/ methacrylic acid co-polymer | copper phthalo-cyanine | none | eicosane | aluminum complex of 3,5-di-t-butyl-salicylic acid | weakly positive |
| Ex. 16 | ethylene/ methacrylic acid co-polymer | copper phthalo-cyanine | none | eicosane | Compound 5-(2) | neither positive nor negative |
| Ex. 17 | ethylene/ methacrylic acid co-polymer | copper phthalo-cyanine | none | eicosane | aluminum complex of 3,5-di-t-butyl-salicylic acid and Compound 5-(2) | both positive and negative |

TABLE 6

| | Amount of Correctly Charged Toner | | Amount of Incorrectly Charged Toner | |
|---|---|---|---|---|
| | Immediately after preparation (mg) | 7 Days after preparation (mg) | Immediately after preparation (mg) | 7 Days after preparation (mg) |
| Ex. 23 | 24.4 | 23.0 | 0.1 | 0.0 |
| Ex. 24 | 26.8 | 24.6 | 0.0 | 0.1 |
| Ex. 25 | 30.6 | 29.8 | 0.1 | 0.1 |
| Ex. 26 | 33.4 | 32.4 | 0.1 | 0.1 |
| Ex. 27 | 21.9 | 20.9 | 0.1 | 0.1 |
| Ex. 28 | 33.5 | 32.8 | 0.1 | 0.1 |
| Ex. 29 | 36.4 | 33.8 | 0.1 | 0.5 |
| Comp. Ex. 13 | 0.3 | 0.3 | 0.1 | 0.9 |
| Comp. Ex. 14 | 0.8 | 0.2 | 0.1 | 0.7 |
| Comp. Ex. 15 | 11.9 | 5.6 | 3.0 | 4.8 |
| Comp. Ex. 16 | 0.1 | 0.9 | 0.2 | 0.6 |
| Comp. Ex. 17 | 7.9 | 6.8 | 3.4 | 3.0 |

The developers obtained in Examples 23 to 29 showed satisfactory positively electrifiable toner characteristics with a reduced amount of incorrectly charged toner. The deposited toner amounts for these developers were also stable even at 7 days after developer preparation. The toners of Comparative Examples 13, 14, and 16 were charged neither positively nor negatively. The deposited toner amounts for the developer of Comparative Example 15 were not larger than ½ of those for the developer of Example 23, and were instable in that the amount of incorrectly charged toner increased at 7 days after developer preparation. The deposited toner amounts for the developer of Comparative Example 17 were not larger than ½ of those for the developer of Example 24, and the amounts of incorrectly charged toner were also large. The deposited toner amounts were instable in that the amount of incorrectly charged toner increased at 7 days after developer preparation.

EXAMPLE 30

An image was actually formed and evaluated using the above-described apparatus for image formation and evaluation. The liquid developer of Example 23 was used to form an image while maintaining the temperature of the liquid developer at 75° C. The image obtained was a satisfactory one having high resolution. Furthermore, the liquid developer of Example 23 was stored for 2,000 hours and then used to conduct 200-sheet continuous copying. As a result, satisfactory images equal to the initial ones were obtained after 100th-sheet copying. These images were completely free from the odor of an organic solvent.

Comparative Example 18

The same image evaluation was conducted using the above-described apparatus for image formation and evaluation. The liquid developer of Comparative Example 13 was used to form an image while maintaining the temperature of the liquid developer at 75° C. The image obtained had a low image density and poor quality. This liquid developer was used to conduct 200-sheet continuous copying. As a result, the image quality declined further to a considerably unsatisfactory level.

EXAMPLE 31

| | |
|---|---|
| 1. Ethylene (89%)-methacrylic acid (11%) copolymer: (Newcrel N699, manufactured by E. I. du Pont de Neumours and Co. | 40 parts |
| 2. Copper phthalocyanine pigment: (Cyanine Blue 4933M, manufactured by Dainichiseika Color & Chemicals Mfg. Co., Ltd.) | 8 parts |
| 3. Charge control agent: Compound 5-(1) (3-laurylamidopropyltrimethylammonium methylsulfate) | 2 parts |
| 4. Norpar 15 (manufactured by Exxon Chemical Co.) | 100 parts |

A mixture of the above ingredients was introduced into a stainless-steel beaker, and then continuously stirred for 1 hour with heating at 120° C. on an oil bath to prepare a homogeneous melt containing the completely molten resin, the pigment, and the charge control agent. The melt obtained was gradually cooled to room temperature with stirring, and 100 parts of Norpar 15 was further added. As the temperature of the system lowered, toner particles precipitated which had a particle diameter of from 10 to 20 μm and contained the pigment and the charge control agent therein. The precipitated toner was introduced into a 01 type attritor (manufactured by Mitsui Miike Engineering Corp.) in an amount of 100 g, and was ground for about 20 hours at a rotor speed of 300 rpm using steel balls having a diameter of 0.8 mm. This grinding was continued until the toner came to have a volume-average particle diameter of 2.5 μm, while the particle diameter was monitored with a particle size distribution analyzer of the centrifugal sedimentation type (SA-CP4L, manufactured by Shimadzu Corp.).

Twenty parts of the thus-obtained concentrated toner (toner concentration, 18% by weight) was diluted with 160 parts of propylene glycol butyl octyl ether, so as to result in a liquid developer having a toner concentration of 2% by weight. The diluted toner was sufficiently stirred. To the liquid mixture obtained was added an aluminum complex of 3,5-di-t-butylsalicylic acid as a charge director in an amount of 0.1 part by weight per part of the toner in the liquid developer. This mixture was sufficiently stirred to produce a liquid developer.

EXAMPLE 32

A concentrated toner was produced in the same manner as in Example 9, except that Compound 5-(2) (stearyltriethylammonium naphthosulfonate) was used as a charge control agent. This toner was similarly diluted with propylene glycol butyl octyl ether. To the liquid mixture obtained was then added an aluminum complex of 3,5-di-butylsalicylic acid as a charge director in the same proportion as in Example 31. This mixture was sufficiently stirred to produce a liquid developer.

EXAMPLE 33

A concentrated toner was produced in the same manner as in Example 31, except that Compound 5-(3) (stearyldimethylbenzylammonium p-toluenesulfonate) was used as a charge control agent and that carbon black (Carbon Black #4000, manufactured by Mitsubishi Chemical Industries Ltd.) was used as a pigment. This toner was similarly diluted with dioctyl ether. To the liquid mixture obtained was then added a boron complex of 3,5-di-t-butylcatechol as a charge director in the same proportion as in Example 31. This mixture was sufficiently stirred to produce a liquid developer.

EXAMPLE 34

| | |
|---|---|
| 1. Polyester resin (polyester resin obtained by polymerizing terephthalic acid with ethylene oxide adduct of bisphenol A and having a weight-average molecular weight ($M_w$) of 12,000, acid value of 5, and softening point of 110° C.) | 85 parts |
| 2. Magenta pigment (Carmine 6B, manufactured by Dainichiseika Color & Chemicals Mfg. Co., Ltd.) | 15 parts |
| 3. Charge control agent: Compound 5-(4) (stearyldimethylbenzylammonium chloride) | 2 parts |

A mixture of the above ingredients was kneaded in an extruder, subsequently pulverized with a jet mill, and then classified with an air classification device to prepare a toner having an average particle diameter of 3 μm.

This powdery toner was dispersed into dioctyl ether to such a proportion as to result in a toner concentration of 2% by weight. To this liquid mixture was then added dioctyl sodium sulfosuccinate as a charge director in the same proportion as in Example 31. This mixture was sufficiently stirred to produce a liquid developer.

EXAMPLE 35

A toner was produced and diluted with propylene glycol butyl octyl ether in the same manner as in Example 31, except that Pigment Yellow 17 (manufactured by Dainichiseika Color & Chemicals Mfg. Co., Ltd.) was used as a pigment.

To the liquid mixture obtained was then added an aluminum complex of 3,5-di-t-butylsalicylic acid as a charge director in the same amount as in Example 31. This mixture was sufficiently stirred to produce a liquid developer.

EXAMPLE 36

The base toner used in Example 31 was used. As a charge director was used the following ionic copolymer. Charge director: copolymer of stearyl methacrylate, methyl methacrylate, and tetrahydroxyethylene methyl methacrylate in a weight ratio of 68/30/2 (number-average molecular weight, 5,000).

This charge director was added in the same manner as in Example 31 to produce a liquid developer.

EXAMPLE 37

A toner was produced in the same manner as in Example 31, except that Compound 6-(1) (cetylpyridinium chloride) was used as a charge control agent for the concentrated toner used in Example 31. A nonionic surfactant having the following chemical structure was used as a charge director.

Charge director: $C_{16}H_{33}—O(CH_2CH_2O)_6—H$

This charge director was added in the same manner as in Example 31 to produce a liquid developer.

Comparative Example 19

A toner was produced in the same manner as in Example 31, except that Compound 6-(2) (cetylpyridinium p-toluenesulfonate) was used as a charge control agent for the concentrated toner used in Example 31. A liquid developer was produced from this toner in the same manner as in Example 31, except that a charge control agent was not added to the toner composition and that a charge director was not added to the liquid mixture.

Comparative Example 20

A liquid developer was produced in the same manner as in Example 31, except that a charge director was not used for the developer used in Example 31.

Comparative Example 21

A charge director was added to the liquid developer of Comparative Example 19 in the same manner as in Example 31 to produce a liquid developer.

Comparative Example 22

A toner was produced in the same manner as in Example 31, except that a charge control agent was not added. One part by weight of Compound 5-(2), used as a charge control agent in Example 32, was dissolved into 100 parts by weight of propylene glycol butyl octyl ether with heating, and this solution was added to the toner in an amount of 0.1 part in terms of Compound 5-(2) amount per part of the toner in the developer in the same manner as in Example 31. This mixture was sufficiently stirred to produce a liquid developer.

Comparative Example 23

A aluminum complex of 3,5-di-t-butylsalicylic acid was added, in the same manner as in Example 31, to the developer used in Comparative Example 22 to produce a liquid developer.

The developer compositions for Examples 31 to 37 and those for Comparative Examples 19 to 23 are shown in Tables 7 and 8, respectively. The evaluation results obtained are shown in Table 9.

TABLE 7

| | Toner composition | | | Carrier composition | | Polarity |
|---|---|---|---|---|---|---|
| | Toner resin | Pigment | Charge control agnet | Carrier liquid | Charge director | of charged toner |
| Ex. 31 | ethylene/ methacrylic acid co-polymer | copper phthalo-cyanine | Compound 5-(1) | propylene glycol butyl octyl ether | aluminum complex of 3,5-di-t-butyl-salicylic acid | positive |
| Ex. 32 | ethylene/ methacrylic acid co-polymer | copper phthalo-cyanine | Compound 5-(2) | propylene glycol butyl octyl ether | aluminum complex of 3,5-di-t-butylsali-cylic acid | positive |

TABLE 7-continued

| | | Toner composition | | Carrier composition | | Polarity |
|---|---|---|---|---|---|---|
| | Toner resin | Pigment | Charge control agnet | Carrier liquid | Charge director | of charged toner |
| Ex. 33 | ethylene/ methacrylic acid co-polymer | Carbon Black #4000 | Compound 5-(3) | dioctyl ether | boron complex of 3,5-di-t-butyl-catechol | positive |
| Ex. 34 | polyester resin | Carmine 6B | Compound 5-(4) | dioctyl ether | dioctyl sodium sulfo-succinate | positive |
| Ex. 35 | ethylene/ methacrylic acid co-polymer | Pigment Yellow 17 | Compound 5-(1) | propylene glycol butyl octyl ether | aluminum complex of 3,5-di-t-butylsali-cylic acid | positive |
| Ex. 36 | ethylene/ methacrylic acid co-polymer | copper phthalo-cyanine | Compound 5-(1) | propylene glycol butyl octyl ether | ionic polymer | positive |
| Ex. 37 | ethylene/ methacrylic acid co-polymer | copper phthalo-cyanine | Compound 6-(1) | propylene glycol butyl octyl ether | nonionic surfactant | positive |

TABLE 8

| | | Toner composition | | Carrier composition | | Polarity |
|---|---|---|---|---|---|---|
| | Toner resin | Pigment | Charge control agnet | Carrier liquid | Charge director | of charged toner |
| Comp. Ex. 19 | ethylene/ methacrylic acid co-polymer | copper phthalo-cyanine | Compound 6-(2) | propylene glycol butyl octyl ether | none | neither positive nor negative |
| Comp. Ex. 20 | ethylene/ methacrylic acid co-polymer | copper phthalo-cyanine | Compound 5-(1) | propylene glycol butyl octyl ether | none | neither positive nor negative |
| Comp Ex. 21 | ethylene/ methacrylic acid co-polymer | copper phthalo-cyanine | none | propylene glycol butyl octyl ether | aluminum complex of 3,5-di-t-butyl-salicylic acid | weakly positive |
| Comp. Ex. 22 | ethylene/ methacrylic acid co-polymer | copper phthalo-cyanine | none | propylene glycol butyl octyl ether | Compound 5-(2) | neither positive nor negative |
| Comp. Ex. 23 | ethylene/ methacrylic acid co-polymer | copper phthalo-cyanine | none | propylene glycol butyl octyl ether | aluminum complex of 3,5-di-t-butyl-salicylic acid and Compound 5-(2) | both positive and negative |

TABLE 9

| | Amount of Correctly Charged Toner | | Amount of Incorrectly Charged Toner | |
|---|---|---|---|---|
| | Immediately after preparation (mg) | 7 Days after preparation (mg) | Immediately after preparation (mg) | 7 Days after preparation (mg) |
| Ex. 31 | 26.5 | 25.0 | 0.1 | 0.0 |
| Ex. 32 | 25.3 | 24.0 | 0.0 | 0.1 |
| Ex. 33 | 31.1 | 29.4 | 0.1 | 0.1 |
| Ex. 34 | 32.8 | 30.6 | 0.1 | 0.1 |
| Ex. 35 | 23.2 | 22.9 | 0.1 | 0.1 |
| Ex. 36 | 34.6 | 32.4 | 0.1 | 0.1 |
| Ex. 37 | 35.0 | 32.8 | 0.1 | 0.1 |
| Comp. Ex. 19 | 0.1 | 0.1 | 0.1 | 0.1 |
| Comp. Ex. 20 | 0.1 | 0.2 | 0.1 | 0.2 |
| Comp. Ex. 21 | 12.1 | 6.8 | 3.0 | 4.1 |
| Comp. Ex. 22 | 0.9 | 0.9 | 0.2 | 0.2 |
| Comp. Ex. 23 | 9.1 | 8.6 | 2.6 | 4.5 |

The developers obtained in Examples 31 to 37 showed satisfactory positively electrifiable toner characteristics with a reduced amount of incorrectly charged toner. The deposited toner amounts for these developers were also stable even at 7 days after developer preparation. The toners of Comparative Examples 19, 20, and 22 were charged neither positively nor negatively. The deposited toner amounts for the developer of Comparative Example 21 were not larger than ½ of those for the developer of Example 22, and were instable in that the amount of incorrectly charged toner increased at 7 days after developer preparation. The deposited toner amounts for the developer of Comparative Example 23 were not larger than ½ of those for the developer of Example 32, and the amounts of incorrectly charged toner were also large. The deposited toner amounts were instable in that the amount of incorrectly charged toner increased at 7 days after developer preparation.

EXAMPLE 38

The concentrated toner used in Example 31 was diluted with a carrier liquid which was a 50:50 by weight mixture of diethylene glycol dibutyl ether and Norpar 15 (Exxon Chemical Co.), to such a degree as to result in a solid concentration of 2% by weight. To the diluted toner was added a charge director in the same manner as in Example 31. Thus, a liquid developer having a toner concentration of 2% by weight was produced.

EXAMPLE 39

The concentrated toner used in Example 31 was diluted with a carrier liquid which was a 50:50 by weight mixture of diethylene glycol dibutyl ether and Isopar L (Exxon Chemical Co.), to such a degree as to result in a solid concentration of 2% by weight. To the diluted toner was added a charge director in the same manner as in Example 31. Thus, a liquid developer having a toner concentration of 2% by weight was produced.

EXAMPLE 40

Twenty parts of the concentrated toner used in Example 31 (toner concentration, 18% by weight) was diluted with a mixture of 80 parts of elcosane ($C_{20}H_{42}$; melting point, 36.8° C.) which had been melted by heating at 75° C. and 80 parts of diethylene glycol dibutyl ether to such a degree as to result in a liquid developer having a toner concentration of 2% by weight. The diluted toner was sufficiently stirred. A charge director was added thereto in the same manner as in Example 9 in an amount of 0.1 part per part of the toner in the developer. This mixture was sufficiently stirred and then transferred to a stainless-steel vat to produce a developer. The amount of deposited toner in development was measured in a 40° C. atmosphere, with the whole measuring system being placed therein.

EXAMPLE 41

The concentrated toner used in Example 31 was diluted with Norpar 15 carrier liquid to such a degree as to result in a solid concentration of 2% by weight. A charge director was added thereto in the same manner as in Example 9 to produce a liquid developer having a toner concentration of 2% by weight.

The developer compositions for Examples 38 to 41 and the evaluation results obtained are shown in Tables 10 and 11, respectively.

TABLE 10

| | Toner composition | | | Carrier composition | | | Polarity |
|---|---|---|---|---|---|---|---|
| | Toner resin | Pigment | Charge control agnet | Carrier liquid | Mixing ratio | Charge director | of charged toner |
| Ex. 38 | ethylene/ methacrylic acid copolymer | copper phthalo-cyanine | Compound 5-(1) | mixture of diethylene glycol di-butyl ether and Norpar 15 | 50:50 | aluminum complex of 3,5-di-t-butyl-salicylic acid | positive |
| Ex. 39 | ethylene/ methacrylic acid copolymer | copper phthalo-cyanine | Compound 5-(1) | mixture of diethylene glycol di-butyl ether and Isopar L | 50:50 | aluminum complex of 3,5-di-t-butyl-salicylic acid | positive |

TABLE 10-continued

| | Toner composition | | | Carrier composition | | | Polarity |
|---|---|---|---|---|---|---|---|
| | Toner resin | Pigment | Charge control agnet | Carrier liquid | Mixing ratio | Charge director | of charged toner |
| Ex. 40 | ethylene/ methacrylic acid copolymer | copper phthalo-cyanine | Compound 5-(1) | mixture of diethylene glycol di-butyl ether and eicosane | 50:50 | aluminum complex of 3,5-di-t-butyl-salicylic acid | positive |
| Ex. 41 | ethylene/ methacrylic acid copolymer | copper phthalo-cyanine | Compound 5-(1) | Norpar 15 | 100 | aluminum complex of 3,5-di-t-butyl-salicylic acid | positive |

TABLE 11

| | Amount of Correctly Charged Toner | | Amount of Incorrectly Charged Toner | |
|---|---|---|---|---|
| | Immediately after preparation (mg) | 7 Days after preparation (mg) | Immediately after preparation (mg) | 7 Days after preparation (mg) |
| Ex. 38 | 29.5 | 26.0 | 0.1 | 0.0 |
| Ex. 39 | 25.3 | 21.0 | 0.0 | 0.1 |
| Ex. 40 | 31.0 | 23.2 | 0.1 | 0.1 |
| Ex. 41 | 16.1 | 14.6 | 0.5 | 2.4 |

The developers obtained in Examples 38, 39, and 40 showed satisfactory positively electrifiable toner characteristics with a reduced amount of incorrectly charged toner and a large amount of deposited toner. The deposited toner amounts for these developers were also stable even at 7 days after developer preparation. The developer of Example 41 showed positively electrifiable toner characteristics with a slightly large amount of incorrectly charged toner. The deposited toner amount for this developer was somewhat small, and decreased slightly at 7 days after developer preparation.

EXAMPLE 42

Using a copier (Type FX-5030, manufactured by Fuji Xerox Co., Ltd.) which had been modified by adapting the black development part for liquid developers, an image was actually formed through reversal development and evaluated.

The liquid developer of Example 31 was used to form an image. The image obtained was a satisfactory one having high resolution. Further, this liquid developer was used to conduct 100-sheet continuous copying. As a result, satisfactory images equal to the initial ones were obtained after 100th-sheet copying.

Comparative Example 24

Using the liquid developer of Comparative Example 11, image evaluation was conducted in the same manner as in Example 42. The image obtained was a low-quality one having a large amount of toner deposited on the background. This image was unsatisfactory also in resolution with respect to narrow lines. This liquid developer was used to conduct 100-sheet continuous copying. As a result, the images obtained after 100th-sheet copying had even lower quality than the initial ones.

Since the liquid developer for electrostatic photography of the present invention has the constitution described above, the effect of the negative-charge control agent contained in the toner and the effect of the charge director dissolved in the carrier are enhanced due to charge exchange between the charge control agent and the charge director. As a result, the toner can be rendered negatively electrifiable, without excessively lowering the electrical resistivity of the carrier. Moreover, since the negative-charge control agent in the liquid developer for electrostatic photography of the present invention is contained in the toner, it can impart sufficient negative electrifiability to the toner even when incorporated in a far smaller amount than the negative-charge control agent in conventional developers in which the charge control agent is contained in the carrier. Consequently, according to the image formation process in which the liquid developer for electrostatic photography of this invention is used, images of satisfactory quality can be obtained stably over a prolonged time period. A further advantage of the liquid developer for electrostatic photography of the present invention is that since the carrier can be replaced, during developer preparation, with a carrier having a desired low vapor pressure, the developer does not generate a solvent vapor and is effective in reducing the amount of carrier discharged from the apparatus during copying. Namely, the developer of the present invention produces the effects that it is odorless, has no fear of fire, and is hence advantageous from the standpoint of environmental protection.

While the invention has been described in detail and with reference to specific embodiments thereof, it will be apparent to one skilled in the art that various changes and modifications can be made therein without departing from the spirit and scope thereof.

What is claimed is:

1. A process for forming an image comprising:

forming a latent image on a latent-image-holding substrate; and developing the latent image with a liquid developer for electrophotography, wherein said liquid developer comprises (a) toner particles having a volume-average particle diameter of from 0.5 μm to 5 μm and comprising a thermoplastic resin substantially carrier-insoluble at the developing temperature of the liquid developer, a colorant, and a charge control agent, (b) a carrier that has an electrical resistivity of $10^8$ to $10^{22}$ Ωcm and in which the toner particles are dispersed, and (c) a charge director contained in the carrier, wherein said carrier comprises at least one ether compound represented by the general formula:

$$R_1O(CH_nH_{2n}O)_xR_2$$

wherein $R_1$ and $R_2$ may be the same or different and each represent an alkyl group, cycloalkyl group, an aryl group, or an aralkyl group, provided that the total number of carbon atoms contained in $R_1$ and $R_2$ is from 6 to 20; and is an integer of 2 or 3; and x is an integer of 0 to 3, and wherein said resin is selected from the group consisting of polyolefins, ethylene copolymers having a polar group, homopolymers of styrene, styrene-acrylic copolymers, polyesters and polyurethanes.

2. The process for forming an image as claimed in claim 1, wherein said carrier has a vapor pressure at 25° C. of 130 Pa or lower and a boiling point of 170° C. or higher.

3. The process for forming an image as claimed in claim 1, wherein the amount of the charge control agent contained in the toner is from 0.1% by weight to 10% by weight based on the amount of the solid compounds of the toner.

4. The process for forming an image as claimed in claim 1, wherein the amount of the charge director contained in the carrier is from 0.01% by weight to 20% by weight based on the amount of the solid components of the toner.

5. The process for forming an image as claimed in claim 1, wherein said toner particles are positively or negatively charged.

6. The process for forming an image as claimed in claim 1, wherein said charge control agent is a negative charge control agent selected from the group consisting of metal salts of benzoic acid, metal complexes of salicylic acid, metal complexes of alkylsalicylic acid, metal complexes of catechol, metallized bisazo dyes, tetraphenylborate derivatives and combinations thereof.

7. The process for forming an image as claimed in claim 1, wherein said charge control agent is a positive charge control agent selected from the group consisting of metal soaps, inorganic and organic metal salts, quaternary ammonium salts, alkylpyridinium salts and combinations thereof.

* * * * *

UNITED STATES PATENT AND TRADEMARK OFFICE

CERTIFICATE OF CORRECTION

PATENT NO. : 5,723,250

DATED : March 3, 1998

INVENTOR(S) : Hirotaka MATSUOKA; Takako KOBAYASHI; and Ken HASHIMOTO

It is certified that error appears in the above-indentified patent and that said Letters Patent is hereby corrected as shown below:

Title page, in item [30], change "May 30, 1909" to --May 30, 1994--.

Title page, in "Attorney, Agent, or Firm", change "Berrdige" to --Berridge--.

Signed and Sealed this

Second Day of June, 1998

*Attest:*

*Attesting Officer*

BRUCE LEHMAN

*Commissioner of Patents and Trademarks*